US008658340B2

(12) United States Patent
Sakashita et al.

(10) Patent No.: US 8,658,340 B2
(45) Date of Patent: Feb. 25, 2014

(54) TONER, DEVELOPMENT AGENT, AND IMAGE FORMING METHOD

(75) Inventors: Shingo Sakashita, Shizuoka (JP); Shinya Nakayama, Shizuoka (JP); Ryota Inoue, Osaka (JP); Yoshihiro Moriya, Shizuoka (JP); Akiyoshi Sabu, Kanagawa (JP); Yukiko Nakajima, Shizuoka (JP); Daiki Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/103,344

(22) Filed: May 9, 2011

(65) Prior Publication Data

US 2011/0281213 A1 Nov. 17, 2011

(30) Foreign Application Priority Data

May 12, 2010 (JP) ..... 2010-109997

(51) Int. Cl.
*G03G 9/087* (2006.01)

(52) U.S. Cl.
USPC ..... 430/109.4; 430/108.4; 430/108.1; 430/108.2; 430/111.4; 430/110.2; 430/123.52

(58) Field of Classification Search
USPC ..... 430/109.4, 108.1, 108.2, 108.4, 110.2, 430/111.4, 123.52
See application file for complete search history.

(56) References Cited

U.S. PATENT DOCUMENTS

| | | | | |
|---|---|---|---|---|
| 5,387,665 | A * | 2/1995 | Misawa et al. | 528/81 |
| 2007/0015077 | A1* | 1/2007 | Yamashita et al. | 430/109.4 |
| 2007/0160782 | A1* | 7/2007 | Yatsuzuka et al. | 428/34.2 |
| 2008/0227002 | A1* | 9/2008 | Moriya et al. | 430/48 |
| 2009/0111043 | A1* | 4/2009 | Joo et al. | 430/109.4 |
| 2010/0183967 | A1 | 7/2010 | Sabu et al. | |
| 2010/0216068 | A1 | 8/2010 | Kotsugai et al. | |
| 2010/0330489 | A1 | 12/2010 | Inoue et al. | |
| 2011/0065036 | A1 | 3/2011 | Inoue et al. | |

FOREIGN PATENT DOCUMENTS

| | | |
|---|---|---|
| CN | 1906248 A | 1/2007 |
| JP | 3762079 | 1/2006 |
| JP | 4057482 | 12/2007 |

OTHER PUBLICATIONS

Chinese Office Action issued Apr. 27, 2012, in Patent Application No. 201110122055.6.
Communication issued on Jan. 31, 2013 by the Chinese Patent Office for Chinese Patent Application No. 201110122055.6, filed May 12, 2011.
Office Action issued Nov. 13, 2013, in Japanese Patent Application No. 2010-109997 filed May 12, 2010.

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner containing a binder resin comprising a first binder resin A and a second binder resin B, a coloring agent, and a releasing agent, wherein the first binder resin A is formed by reacting a compound A1 having an active hydrogen group with a resin A2 having a portion reactive with the compound A1 in an organic solvent and the resin A2 is formed by reacting a non-crystalline polyester resin "a" having a poly-hydroxy carboxylic acid skeleton in the main chain with a compound having the portion reactive with the compound A1 having an active hydrogen group.

8 Claims, 4 Drawing Sheets

TONER, DEVELOPMENT AGENT, AND IMAGE FORMING METHOD

BACKGROUND OF THE INVENTION

1. Field of the Invention

The present invention relates to toner, a development agent, and an image forming method, 2. Description of the Background Electric or magnetic latent images are rendered visible with toner in an image forming apparatus employing electrophotography, an electrostatic recording device, etc.

For example, in electrophotography, an electrostatic image (latent image) is formed on an image bearing member (e.g., photoreceptor) and then developed with toner to form a toner image. The toner image is then transferred onto a recording medium such as paper and fixed thereon.

In an image forming apparatus employing a fixing system by heating, a great amount of electric power is required to fix the toner on the recording media such as paper by heating and fusing. Therefore, in terms of energy saving, the ability to fix the image at low temperature (hereinafter referred to as low temperature fixing property) is one of the key characteristics for the toner.

To obtain toner having a good low temperature fixing property, controlling the thermal characteristics of binder resins occupying a large part of the toner composition is necessary. For example, the low temperature fixing property tends to be improved by reducing the molecular weight of the binder resin and the glass transition temperature (Tg). However, this reduction creates another problem, that of lowering the upper limit of the fixing temperature, resulting in a narrow fixing range.

In general, there is a trade-off between fixing temperature and fixing range: the lower the fixing temperature, the narrower the fixing range. Therefore, much research has been directed to finding a good combination of fixing temperature and fixing range. For example, toner has been developed that includes both a binder resin having a low molecular weight component with a good low temperature fixing property and a polymer component produced by reaction of a copolymer (referred to as a prepolymer) having an isocyanate group and a polyamine to raise the upper limit of the fixing temperature.

Accordingly, to a certain degree the above-described toner achieves a good combination of the low temperature fixing property and a wide fixing range, but in the current climate of energy efficiency remains inadequate, due to its high-level demand for energy. In addition, the polymer component produced by such reaction is easily positively charged. Therefore, if this toner is used as a negatively charged toner, which is currently the main type of the toner in use, the toner cannot be sufficiently negatively charged.

SUMMARY OF THE INVENTION

For these reasons, the present inventors recognize that a need exists for a toner having a good combination of fixing range and low temperature fixing property with stable chargeability, a development agent containing the toner, and an image forming method using the development agent.

Accordingly, an object of the present invention is to provide a toner having a good combination of fixing range and low temperature fixing property with stable chargeability, a development agent containing the toner, and an image forming method using the development agent.

Briefly this object and other objects of the present invention as hereinafter described will become more readily apparent and can be attained, either individually or in combination thereof, by a toner containing a binder resin containing a first binder resin A and a second binder resin B, a coloring agent, and a releasing agent, wherein the first binder resin A is formed by reacting a compound A1 having an active hydrogen group with a resin A2 having a portion reactive with the compound A1 in an organic solvent and the resin A2 is formed by reacting a non-crystalline polyester resin "a" having a polyhydroxy carboxylic acid skeleton in the main chain with a compound having the portion reactive with the compound A1 having an active hydrogen group.

It is preferable that the toner mentioned above further contains a portion insoluble in tetrahydrofuran (THF) deriving from the binder resin.

It is still further preferable that, in the toner mentioned above, the second resin B is a non-crystalline polyester resin "b" having a polyhydroxy carboxylic acid skeleton in a main chain thereof.

It is still further preferable that, in the toner mentioned above, the non-crystalline polyester resin "b" has a hydroxyl carboxylic acid skeleton formed of an optically active monomer, and the hydroxyl carboxylic acid skeleton has an optical purity X (%) of 80% or less, which is represented by the following relation:

$$\text{optical purity } X(\%)=|X(L\text{ form})-X(D\text{ form})|$$

where X (L form) represents an L form ratio (mol %) in optically active monomer conversion and X (D form) represents a D form ratio (mol %) in an optically active monomer conversion.

It is still further preferable that the toner mentioned above has a structure in which a resin particulate "c" formed of a third binder resin C is attached to the surface of the toner.

It is still further preferable that, in the toner mentioned above, the non-crystalline polyester resin "a" is a straight chain polyester diol having a polyhydroxy carboxylic acid skeleton.

It is still further preferable that, in the toner mentioned above, the polyhydroxy carboxylic acid skeleton of the non-crystalline polyester resin "a" is obtained by ring-opening polymerization of a mixture of L-lactide and D-lactide.

It is still further preferable that, in the toner mentioned above, the polyhydroxy carboxylic acid skeleton of the non-crystalline polyester resin "a" is obtained by ring-opening polymerization of a meso-type DL-lactide.

It is still further preferable that the toner mentioned above is obtained by dissolving or dispersing the compound A1 having an active hydrogen group, the resin A2 having a portion reactive with the compound A1, the second resin B, the coloring agent, and the releasing agent in an organic solvent to obtain a lysate or a dispersion material, dispersing or emulsifying the lysate or the dispersion material in an aqueous medium to conduct cross-linking reaction or elongation reaction of the compound A1 having an active hydrogen group and the resin A2 to obtain a liquid dispersion or an emulsified liquid, and removing the organic solvent from the liquid dispersion or the emulsified liquid after or in the middle of the cross-linking reaction or elongation reaction.

As another aspect of the present invention, a development agent is provided which includes a carrier and the toner mentioned above.

As another aspect of the present invention, an image forming method is provided which includes forming a latent electrostatic image on an image bearing member, developing the latent electrostatic image a development agent containing a carrier and a toner to obtain a toner image, transferring the toner image to a recording medium, and fixing the toner image on the recording medium, wherein the toner contains a binder resin containing a first binder resin A and a second binder resin B, a coloring agent, and a releasing agent, and the first binder resin A is formed by reacting a compound A1 having an active hydrogen group with a resin A2 having a portion reactive with the compound A1 in an organic solvent and the resin A2 is formed by reacting a non-crystalline polyester resin "a" having a polyhydroxy carboxylic acid skeleton in the main chain with a compound having the portion reactive with the compound A1 having an active hydrogen group.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
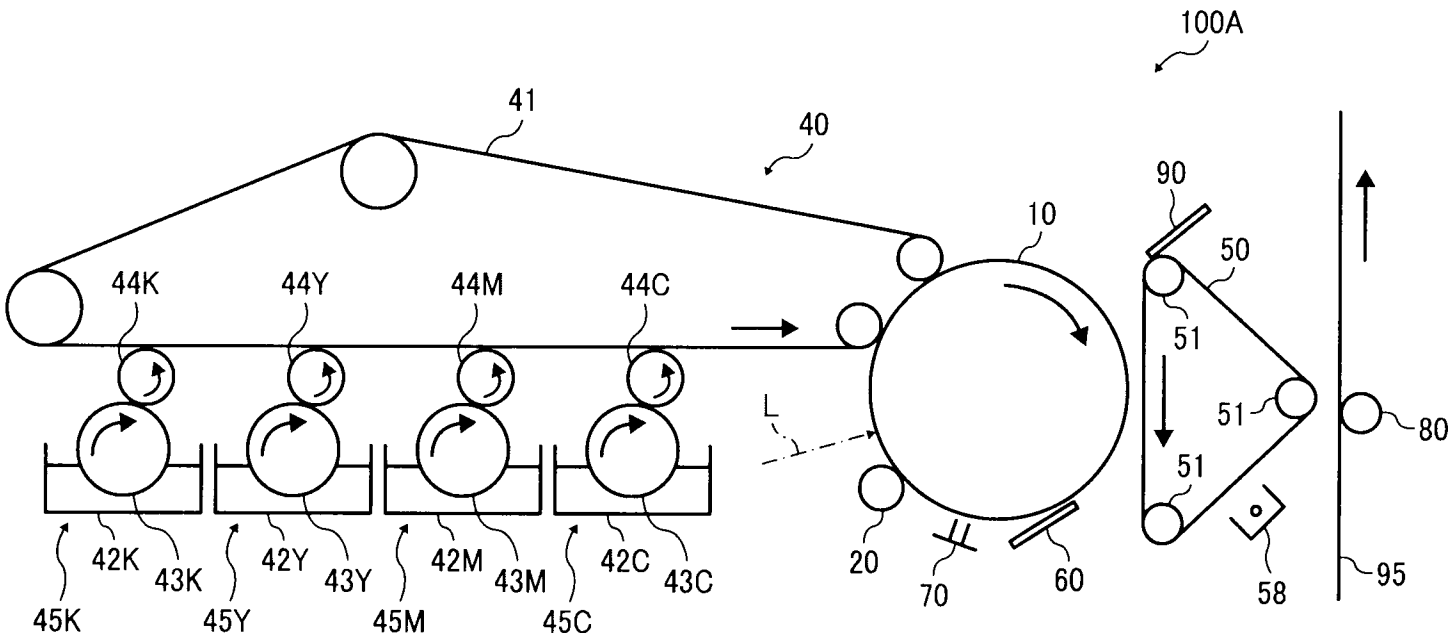
FIG. 1 is a schematic diagram illustrating an example of an image forming method of the present disclosure executed by an image forming apparatus.

The present inventors have made an intensive study about the issue in the development of toner having a good combination of the fixing range and the low temperature fixing property with a stable chargeability and found the following.

That is, a toner having a binder resin containing a first binder resin A and a second binder resin B, a coloring agent, and a releasing agent solves the issue. The first binder resin A is produced by the reaction between a compound A1 having an active hydrogen group and a resin A2 having a portion reactive with the compound A1 in an organic solvent. The resin A2 is formed by reacting a non-crystalline polyester resin "a" having a polyhydroxy carboxylic acid skeleton in its main chain with a compound having the portion reactive with the compound A1 having an active hydrogen group.

It is also found that images with excellent transparency are obtained by regulating the second resin B to have a polyhydroxy carboxylic acid skeleton formed by an optical active monomer and a suitable optical purity.

The materials forming the toner of the present disclosure are described below.

Toner

The toner of the present disclosure contains a binder resin containing a first binder resin A and a second binder resin B, a coloring agent, and a releasing agent. The first binder resin A is produced by the reaction between a compound A1 having an active hydrogen group and a resin A2 having a portion reactive with the compound A1 in an organic solvent. The resin A2 is formed by reacting a non-crystalline polyester resin "a" having a polyhydroxy carboxylic acid skeleton in its main chain with a compound having a portion reactive with the compound A1 having an active hydrogen group.

First Binder Resin A

The first binder resin A contained in the toner of the present disclosure is produced by reacting the compound A1 having an active hydrogen group and the resin A2 having a portion reactive with the compound A1 in an organic solvent. Hereinafter, the resin A2 is referred to as a prepolymer A2.

Compound A1 Having Active Hydrogen Group

Specific examples of the compound A1 having an active hydrogen group include, but are not limited to, polyamines, polyols, and polymercaptane which may be blocked by a detachable compound and water. Among these, water, polyamines, and polyols are preferable. Water and polyamines are more preferable and water and blocked amines are preferable in particular.

Specific examples of the polyamines include, but are not limited to, (1) aliphatic polyamines (having 2 to 18 carbon atoms): [1] Alkylene diamine (having 2 to 6 carbon atoms) (e.g., ethylene diamine, propylene diamine, trimethylene diamine, tetramethylene diamine, and hexamethylene diamine): polyalkylene (having 2 to 6 carbon atoms) polyamine (e.g., diethylene triamine, iminobispropyl amine, bis(hexamethylene) triamine, triethylene tetraamine, tetraethylene pentamine, and pentaethylene hexamine); [2] alkyl (having 1 to 4 carbon atoms) or hydroxy alkyl (having 2 to 4 carbon atoms) substitutes of [1]: dialkyl (having 1 to 3 carbon atoms) aminopropyl amine, trimethylhexamethylene diamine, aminoethylethanol amine, 2,5-dimethyl-2,5-hexamethylene diamine, and methylimino bispropyl amine); [3] alicyclic polyamine or aliphatic polyamine having a heterocyclic ring (e.g. 3,9-bis(3-aminopropyl)-2,4,8,-10-tetraoxaspiro[5,5]undecane); [4] aliphatic amines (having 8 to 15 carbon atoms) having aromatic ring (e.g., xylylene diamine, tetrachloro-p-xylylene diamine), alcyclic polyamine (having 4 to 15 carbon atoms): 1,3-diaminocyclohexane isophorone diamine, menthane diamine and 4,4'-methylene dicyclohexane diamine (hydrogenerated methylene dianiline; heterocyclic polyamines (having 4 to 15 carbon atoms): piperazine, N-aminoethyl piperazine, 1,4-diaminoethyl piperazine, and 1,4-bis(2-amino-2-methyl propyl)piperazine; aromatic polyamines (having 5 to 20 carbon atoms); (2) Non-substitutional aromatic polyamines: 1,2-, 1,3-, or 1,4-phenylene diamine, 2,4'- or 4-4'-diphenyl methane diamine, crude diphenyl methane diamine (polyphenyl polymethylene polyamine), diaminodiphenyl sulfone, bendidine, thiodianiline, bis(3,4-diaminophenol)sulfone, 2,6-diamino pyridine, m-aminobenzyl amine, triphenylmethane-4,4',4"-triamine, and naphthylene diamine; (3) Aromatic polyamines having nuclear substitution alkyl groups (having 1 to 4 carbon atoms such as methyl, ethyl, or n- or i-propyl, butyl): 2,4- or 2,6-trilene diamine, crude trilene diamine, diethyl trilene diamine, 4,4'-diamino-3,3'-dimethyldiphenyl methane, 4,4'-bis(o-toluidine), dianisidine, diaminoditolyl sulfone, 1,3-dimethyl-2,4-diamino benzene, 1,3-dimethyl-2,6-diamino benzene, 1,4-diisopropyl-2,5-diaminobenzene, 2,4-diamino mesitylene, 1-methyl-3,5-diethyl-2,4-diaminobenzene, 2,3-dimethyl-1,4-diaminonaphthalene, 2,6-dimethyl-1,5-diaminonaphthalene, 3,3,5,5-tetramethylbendidine, 3,3,5,5-tetramethyl-4,4'-diaminodiphenyl methane, 3,5-diethyl-3'-methyl-2'4-diaminodiphenyl methane, 3,3'-diethyl-2,2'-diaminodiphenyl methane, 4,4-diamino-3,3'-dimethyldiphenyl methane, 3,3,5,5-tetraethyl-4,4-diamino benzophenone, 3,3,5,5-tetraethyle-4,4'-diamino diphenylether, 3,3,5,5-tetraisopropyl-4,4'-diaminodiphenyl sulfone, and mixtures of isomers thereof; (4) Aromatic polyamines having nuclear substitution electron withdrawing group (e.g. halogens such as Cl, Br, I, and F); alkoxy groups such as methoxy group and ethoxy group); and nitro group):

methylenebis-o-chloroaniline, 4,-chloro-o-phenylene diamine, 2-chloro-1,4-phenylene diamine, methylenebis-o-chloroaniline, 4,-chloro-o-phenylene diamine, 2-chloro-1,4-phenylene diamine, 3-amino-4-chloroaniline, 4-bromo-1,3-phenylene diamine, 2,5-dichloro-1,4-phenylene diamine, 5-nitro-1,3-phenylene diamine, 3-dimethoxy-4-aminoaniline; 4,4'-diamino-3,3'-dimethyl-5,5'-dibromo-diphenylmethane, 3,3-dichlorobendidine, 3,3-dimethoxy bendidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4-methylenebis(2-Iodoaniline), 4,4-methylenebis(2-bromoaniline), 4,4-methylenebis(2-fluoroaniline), 4-aminophenyl-2-chloroaniline); (5) Aromatic polyamines having secondary amino groups {part or all of —$NH_2$ of the arimatic polyamines of (2) to (4) is substituted by —NH—R' (R' represents a lower alkyl group such as methyl group and ethyl group)}: 4,4-di(methylamino)diphenylmethane, and 1-methyl-2-methylamino-4-aminobenzene; polyamideamine: polyamide amines having a lower molecular weight obtained by condensation of dicarboxylic acid (e.g., dimer acid) with an excessive (2 mol or more per 1 mol of acid) polyamine (alkylene diamines and polyalkylene polyamines specified above); and polyether amines: hydrogenerated compound of cyanoethylenized compound of a polyether polyol (e.g. polyalkylene glycol). Among these, 4,4' diaminodiphenyl methane, xylylene diamine, isophorone diamine, ethylene diamine, diethylene triamine, triethylene tetramine, and mixtures thereof are particularly preferable.

Specific examples of the polyamines blocked by a detachable compound include, but are not limited to, ketimine compounds obtained by the polyamines specified above and ketones having 3 to 8 carbon atoms (e.g., acetone, methylethylketone, and methylisobutylketone), aldimine compounds obtained from aldehyde compounds having 2 to 8 carbon atoms (e.g., formaldehyde and acetoaldehyde), enamine compounds, and oxazoline compounds.

Specific examples of the polyols specified above include, but are not limited to, diols, polyols (triols or higher polyols) and using diol or a mixture of diol with a small amount of polyols (triols or higher polyols) is preferable.

Specific examples of the diols include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with 1 to 10 mols of an alkylene oxide (e.g., ethylene oxide, propylene oxide and butylene oxide); and adducts of the bisphenols mentioned above with 2 to 10 mols of an alkylene oxide (e.g., ethylene oxide, propylene oxide and butylene oxide); etc. Among these compounds, alkylene glycols having 2 to 12 carbon atoms and adducts of a bisphenol with an alkylene oxide are preferable. Adducts of bisphenol with an alkylene oxide and mixtures of an adduct of a bisphenol with an alkylene oxide and an alkylene glycol having 2 to 12 carbon atoms are particularly preferable.

Specific examples of the polyols (triols or higher polyols) include, but are not limited to, aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Specific examples of polymercaptanes include, but are not limited to, ethylene diol, 1,4-butane dithiol, and 1,6-hexane dithiol.

Optionally, a reaction terminator can be used with the compound A1 having an active hydrogen group. By a combinational use of the reaction terminator and the compound A1 having an active hydrogen group in a predetermined ratio, the molecular weight of the resins obtained by reacting the prepolymer A2 and the compound A1 having an active hydrogen group can be adjusted to have a desired value.

Specific examples of the reaction terminator include, but are not limited to, monoamine (diethylamine, dibutylamine, butylamine, laurylamine, monoethanol amine, diethanol amine, etc.); blocked monoamines (ketimine compounds); monools (methanol, ethanol, isopropano, butanol, phenol, etc.); monomercaptane (butyl mercaptane, lauryl mercaptane); and monoisocyanate (lauryl isocyanate phenyl isocyanate); and monoepoxide (butyl glycidyl ether, etc.).

The equivalent ratio A2/A1 of the equivalent amount A2 of the reactive groups in the prepolymer A2 to the equivalent amount A1 of the active hydrogen containing group in the compound A1 having an active hydrogen group is preferably from 1/2 to 2/1, more preferably from 1.5/1 to 1/1.5, and particularly preferably from 1.2/1 to 1/1.2. When the compound A1 having an active hydrogen group is water, it is treated as a divalent active hydrogen compound.

Prepolymer A2

The prepolymer A2 is a resin obtained by reacting the non-crystalline polyester resin "a" having a portion reactive with the compound A1 having an active hydrogen group and a polyhydroxycarboxylic acid skeleton in its main chain with a compound having a portion reactive with the compound A1 having an active hydrogen group.

The non-crystalline polyester resin "a" represents a resin structured to have a polycondensation product such as lactic acid and hydroxyalkyl carboxylic acid as a repeating unit. These resins have the main chain of the resin skeleton containing an ester group with a high concentration and a short chain of an alkyl group as a branch chain. In comparison with a typical polyester resin having an aromatic chain as the main chain, the non-crystalline polyester resin "a" has a high concentration of ester group per molecular weight and a high transparency in a non-crystalline state. In addition, such a resin has a high affinity with various kinds of coloring agents although the amount of the functional groups such as organic acid such as carboxylic acid and hydroxyl group is small.

The polyhydroxycarboxylic acid skeleton has a (co)polymerized skeleton of hydroxycarboxylic acid and can be formed by a direct dehydration condensation method of hydroxycarboxylic acid or a ring-opening polymerization method of a corresponding cyclic ester.

As to the polymerization method, the ring-opening polymerization method of a corresponding cyclic ester is preferable in terms of increasing the molecular weight of a polymerized polyhydroxycarboxylic acid.

As the monomer forming the polyhydroxycarboxylic acid skeleton skeleton, aliphatic hydroxycarboxylic acid is preferable in terms of the transparency and the thermal characteristics of the toner.

Hydroxycarboxylic acids having 2 to 6 carbon atoms are more preferable and specific examples thereof include, but are not limited to, lactic acid, glycol acid, and 3-hydroxy butyrate. Among these, lactic acid is particularly preferable.

In addition to hydroxycarboxylic acid, cyclic esters of hydroxycarboxylic acid can be used as raw materials that form the polyhydroxycarboxylic acid skeleton. In this case, the hydroxycarboxylic acid skeleton of the polymerized resin is a polymerized skeleton of the hydroxycarboxylic acid forming the cyclic ester. For example, the polyhydroxycarboxylic acid skeleton of the resin obtained by using lactide is a skeleton in which lactic acid is polymerized.

When the polyhydroxycarboxylic acid skeleton is formed, polyester diol (a11) containing a polyhydroxycarboxylic acid skeleton is obtained by copolymerization by addition of diol (11). Preferred specific examples of the diols include, but are not limited to, 1,2-propane diol, 1,3-propane diol, 1,4-butane diol, and 1,6-hexanediol), alkylene oxides (AO) of bisphenols (e.g., bisphenol A, bisphenol F and bisphenol S): ethylene oxide (EO), propylene oxide (PO), and butylene oxide (BO); and adducts of 2 to 30 mol of the bisphenols mentioned above with 2 to 10 mols of an alkylene oxide (e.g., ethylene oxide, propylene oxide and butylene oxide); and mixtures thereof. Among these, 1,2-propane diol, 1,3-propane diol, 1,4-butane diol, and adducts of bisphenol A of an alkylene oxide are more preferable and 1,3-propane diol is particularly preferable.

In addition, a non-crystalline polyester resin "a" containing a straight chain polyester diol having a polyhydroxycarboxylic acid skeleton is preferable to improve the low temperature fixing property.

Although there is no specific limit to the portion reactive with the compound A1 having an active hydrogen group, isocyanate group or epoxy group is preferable. The isocyanate group includes a blocked isocyanate group blocked by a blocking agent.

Specific examples of the blocking agents include, but are not limited to, oximes (e.g. acetooxime, methyl isobutyl ketone oxime, diethylketone oxime, cyclopentanone oxime, cyclohexanone oxime, and methylethyl keone oxime); lactams (e.g., γ-butylolactam, ϵ-caprolactam, and γ-valerolactam); aliphatic alcohols having 1 to 20 carbon atoms (e.g., ethanol, methanol, and octanol); phenols (e.g., phenol, crezol, xylenol, and nonyphenol); activated methylene compound (e.g., acetylacetone, ethyl marate, and acetoethyl acetate); basic nitrogen-containing compound (e.g., N,N-diethyl hydroxylamine, 2-hydroxypyridine, pyridine N-oxide, and 2-mercapto pyridine); and mixtures thereof. Among these, oximes are preferable and methylethylketone oxime is particularly preferable.

A specific method of obtaining a non-crystalline polyester resin "a" containing an isocyanate group or an epoxy group is to react a hydroxyl group remaining at the end of the non-crystalline polyester resin "a" with a compound such as a polyisocyanate compound or a polyepoxide compound which has a portion reactive with the compound A1 having an active hydrogen group. Known reaction can be used.

Specific examples of the polyisocyanate compounds include, but are not limited to, 1,3- and/or 1,4-phenylene diisocyanate, 2,4- and/or 2,6-tolylene diisocyanate (TDI), 2,4'- and/or 4,4'-diphenyl methane diisocyanate (MDI), hexamethylene diisocyanate (HDI), dicyclohexylmethane-4,4'-diisocyanate (hydrorogenerated MDI), isophorone diisocyanate (IPDI), and bisphenol A diglycidyl ether. Among these, HDI and IPDI are more preferable and IPDI is particularly preferable.

Diepoxide compounds are preferable as the polyepoxide compounds. Specific examples thereof include, but are not limited to, polyglycidyl ether (ethylene glycol diglycidyl ether, tetramethylene glycol diglycidyl ether, bisphenol A diglycidyl ether, bisphenol F diglycidyl ether, glycerin tricidyl ether, pentaerythritol tetraglycidyl ether, phenol novolac glycidyl ether compound); and diene oxide (e.g., pentadiene dioxide and hexadiene dioxide). Among these, polyglycidyl ether is preferable.

A suitable mixing ratio (i.e., [NCO]/[OH]) of a polyisocyanate (PIC) to a polyester resin (PE) having a hydroxyl group to obtain a polyester prepolymer having an isocyanate group is from 1/1 to 1/1, preferably from 4/1 to 1.2/1 and more preferably from 2.5/1 to 1.5/1.

The average number of the reaction group contained per molecule in the prepolymer A2 is 1 or more groups, preferably from 1.5 to 3 groups, and more preferably from 1.8 to 2.5 groups. The molecular weight of the first binder resin A obtained by reaction with the compound A1 having an active hydrogen group increases in this range.

The number average molecular weight Mn of the prepolymer A2 is preferably from 500 to 30,000, more preferably from 1,000 to 20,000, and particularly preferably from 2,000 to 10,000. The weight average molecular weight Mw of the prepolymer A2 is preferably from 1,000 to 50,000, more preferably from 2,000 to 40,000, and particularly preferably from 4,000 to 20,000.

The viscosity of the prepolymer A2 is preferably 2,000 poise or less and more preferably 1,000 poise or less at 100° C. A prepolymer A2 having a viscosity of 2,000 poise or less tends to contribute to manufacturing of mother toner particles having a sharp particle size distribution in a small amount of organic solvent.

THF Insoluble Portion

In addition, the toner of the present disclosure preferably has a tetrahydrofuran insoluble portion deriving from the binder resin.

A toner containing a THF insoluble portion in a suitable amount is good to improve the hot offset resistance and the fixing range. The THF insoluble portion in color toner is advantageous for the hot offset resistance but surely have an adverse impact on the gloss or the transparency of a transparent sheet. However, by adjusting the amount of the THF insoluble amount and using a binder resin having a polyhydroxycarboxylic acid skeleton which is excellent about the transparency, the toner can have a good combination of the fixing range and the gloss/transparency.

The adjustment of the amount of the THF insoluble portion in toner can be made by controlling elongation and/or cross-linking of the prepolymer A2 by the acid value of the second binder resin B. The measuring method is described below.

Method of Measuring THF Insoluble Portion

Weigh about 1.0 g of a resin or toner A. Add about 50 g of THF followed by aging at 20° C. for 24 hours. Separate the resultant by centrifugal followed by filtration with a paper filter (JIS P3801 5C). Dry the solvent of the filtrate in vacuum and measure the amount of the remaining B of the resin. This remaining is the THF soluble portion.

THF insoluble portion (%) is obtained by the following relation.

$$\text{THF insoluble portion}(\%)=(A-B)/A\times 100$$

In the case of toner, THF insoluble portion W1 and THF soluble portion other than the resin can be measured by a known method such as TG method and obtained by the following relation.

$$\text{THF insoluble portion}(\%)=(A-B-W2)/(A-W1-W2)\times 100$$

Second Binder Resin B

Specific examples of the second binder resin B contained in the toner of the present disclosure include, but are not limited to, any known binder resins for toner such as styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methylethyl ketone copolymers, styrene-butadiene copolymers, styrene-isopropyl copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polyesters, epoxy resins, polyvinyl butyral, polyacrylic resins, rosin, modified rosins, terpene resins, phenol resins, aliphatic or aromatic hydrocarbon resins, and aromatic petroleum resins. Among these, polyester resins are preferable. In particular, the non-crystalline polyester resin "b" having a polyhydroxycarboxylic acid skeleton in its main chain is most preferable.

Preferable monomers forming the polyhydroxycarboxylic acid skeleton of the non-crystalline polyester resin b are the same as those for the non-crystalline polyester resin "a". In particular, compounds such as lactic acid and hydroxy butyric acid forming optical isomers are preferable.

The non-crystalline polyester resin "b" preferably contains the polyhydroxycarboxylic acid skeleton formed of these optically-active monomers and the polyhydroxycarboxylic acid formed of the optically-active monomers preferably has an optical purity of 80% or less in an optically active monomer composition conversion calculated by the following relation: optical purity (%)=|X (L form)−X (D form)|, where X (L form) is the ratio (mol %) of L- in optically active monomer composition conversion and X (D form) is the ratio (mol %) of D form in optically active monomer composition conversion.

More preferably, the optical purity is 60% or less. Within this range, the solubility in the solvent and the transparency of the resin ameliorate.

In the case of lactic acid, the lactic acid monomer has an L form and a D form. Non-crystalline polylactic acid skeleton is formed by having a D form ratio within the above-mentioned range.

Furthermore, this resin makes a resin in which the monomer specified above such as hydroxylic acid is coexistent.

In addition, the glass transition temperature of a resin formed of the lactic monomer can be lowered by mixing another hydroxyalkyl carboxylic acid therewith. Therefore, by such a combinational use, the thermal characteristics of the resin can be desirably controlled.

Moreover, a resin having another skeleton having no adverse impact on the crystalline property and the transparency can be used as a copolymerization material. For example, the composition of the resin can be changed by a combinational use of polyalcohols and acids such as diols, dicarboxylic acids, glycerine, and glycol acids with polyhydroxylic acids such as malic acid and tartaric acid.

These resins can be obtained by any known method such as a method of mixing a monomer such as lactic acid and other compositions followed by direct dehydropolymerization under the presence of a suitable catalyst and an optional alcohol, a method of ring-opening polymerization via lactide which is a dimer obtained by dehydration of a monomer, and a synthesizing method using enzyme reaction of lipase, etc.

The non-crystalline resin can be obtained by a combinational use of a monomer having an L form and a D form in a suitable amount to obtain racemic substance. When a lactide is used, L-lactide and D-lactide can be separately mixed. In addition, a non-crystalline resin can be obtained by a ring opening polymerization of meso-lactide or mixing one of L-form and D-form lactide with meso-lactide.

The weight average molecular weight Mw of the non-crystalline polyester resin "b" is preferably from 7,000 to 70,000, more preferably from 10,000 to 40,000 and most preferably from 15,000 to 35,000 in terms of the high temperature preservability and the low temperature fixing property.

Moreover, the glass transition temperature of the non-crystalline polyester resin "b" is preferably from 50° C. to 70° C. and more preferably from 55° C. to 65° C. When the glass transition temperature is too low, the high temperature preservability tends to deteriorate. When the glass transition temperature is too high, the low temperature fixing property tends to deteriorate.

There is no specific limit to the measuring method of optical purity X.

For example, the optical purity X can be obtained as follows: adding a polymer or toner having a polyester skeleton to a solvent mixture of 1 normal sodium hydroxide and isopropyl alcohol, heating and stirring the mixture for hydrolysis, filtering the mixture to remove the solid portion, adding sulfuric acid thereto for neutralization to an aqueous solution containing L-form and/or D-form lactic acid decomposed from the polyester resin, and measuring the aqueous solution with a high speed liquid chromatograph (HPLC) using chiral ligand exchange type column (SUMICHICAL OA-5000, manufactured by Sumica Chemical Analysis Service, Ltd.) to calculate the peak area S (L) deriving from L-form lactic acid and the peak area S (D) deriving from D-form lactic acid. The optical purity X can be obtained by the peak areas as follows:

$$X(L\text{ form})(\%)=100\times S(L)/\{S(L)+S(D)\}$$

$$X(D\text{ form})(\%)=100\times S(D)/\{S(L)+S(D)\}$$

$$\text{Optical purity } X(\%)=|X(L\text{ form})-X(D\text{ form})|$$

The ratio of the first binder resin A and the second binder resin B in mass is preferably from 75/25 to 90/10 and more preferably from 80/20 to 85/15.

Resin Particulate "c" Formed of Third Binder Resin C

There is no specific limit to the resin particulate "c" formed of the third binder resin C contained in the toner of the present disclosure and any known resin can be suitably selected. However, resin particulates formed of a polyester resin having a glass transition temperature of from 55° C. to 80° C. are preferable.

When the glass transition temperature is too low, the high temperature preservability tends to deteriorate. When the glass transition temperature is too high, the low temperature fixing property tends to deteriorate. When the glass transition temperature is too low or high, maintaining a good combination of the high temperature preservability and the low temperature fixing property may be difficult.

The volume average particle diameter of the resin particulate C is preferably from 10 nm to 300 nm and more preferably from 30 nm to 120 nm. The weight average molecular weight is preferably from 9,000 to 45,000.

Coloring Agent

Suitable coloring agents (coloring material) for use in the toner of the present disclosure include known dyes and pigments. Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Green B, Green Gold, Acid Green Lake, Malachite Green Lake, Phthalocyanine Green, Anthraquinone Green, titanium oxide, zinc oxide, lithopone and the like. These can be used alone or in combination.

There is no specific limit to the selection of the color of the toner and black toner, cyan toner, magenta toner, and yellow toner can be used. Each color toner can be obtained by selecting one of the coloring agents specified above. Color toner is preferable.

Specific examples of the coloring agents for black color include, but are not limited to, carbon black (C.I. pigment black 7) such as furnace black, lamp black, acetylene black, and channel black, copper, iron (C.I. pigment black 11), metals such as titanium oxide, and organic pigments such as aniline black (C.I. pigment black 1).

Specific examples of the coloring agents for magenta color include, but are not limited to, C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 18:1, 49, 50, 51, 52, 53:1, 54, 55, 57, 57:1, 58, 60, 63, 64, 68, 81, 83, 87, 88, 89, 90, 112, 114, 122, 123, 163, 177, 179, 202, 206, 207, 209, 211, C.I. pigment violet 19, C.I. vat red 1, 2, 10, 13, 15, 23, 29, and 35.

Specific examples of the coloring agents for cyan color include, but are not limited to, C.I. pigment blue 2, 3, 15, 15:1, 15:2, 15:3, 15:4, 15:6, 16, 17, 60, C.I. vat blue 6, C.I. acid blue 45, or copper phthalocyanine pigments in which 1 to 5 phthalimide methyl groups are substituted to a phthalocyanine skeleton, green 7, green 36.

Specific examples of the coloring agents for yellow color include, but are not limited to, C.I. pigment yellow 0-16, 1, 2, 3, 4, 5, 6, 7, 10, 11, 12, 13, 14, 15, 16, 17, 23, 55, 65, 73, 74, 83, 97, 110, 151, 154, 180, C.I. vat yellow 1, 3, 20, and orange 36.

The content of the coloring agent in the toner is preferably from 1 to 15% by weight, and more preferably from 3 to 10% by weight. When the content of the coloring agent is too small, the coloring performance of the toner tends to deteriorate. To the contrary, when the content of the coloring agent is too great, dispersion of a pigment in the toner tends to be insufficient, thereby degrading the coloring performance and the electric characteristics of the toner.

The coloring agent and the resin can be used in combination as a master batch. Specific examples of such resins include, but are not limited to, polyester, polymers of styrene or its substitution products, styrene-based copolymers, polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic acid resin, rosin, modified rosin, terpene resin, aliphatic hydrocarbon resins, alicyclic hydrocarbon resins, aromatic petroleum resins, chlorinated paraffin, and paraffin wax. These can be used alone or in combination. Among these, polyesters and polylactic acids are preferable in terms of the compatibility with the binder resin in the present disclosure.

The master batch can be manufactured by applying a high shearing force to the resin and the coloring agent for mixing or kneading. In this case, an organic solvent can be used to boost the interaction between the coloring agent and the resin. In addition, so-called flushing methods and a wet cake of the coloring agent can be used as they are, which is advantageous in that there is no need to drying. The flushing method is a method in which a water paste containing water of a coloring agent is mixed or kneaded with an organic solvent and the coloring agent is transferred to the resin side to remove water and the organic solvent. High shearing dispersion devices such as a three-roll mill, etc. can be used for mixing or kneading.

Releasing Agent

There is no specific limit to the releasing agent for use in the toner of the present disclosure. Any known releasing agent can be suitably used and in particular carnauba wax from which free fatty acid is removed, polyethylene wax, montan wax, and oxidized rice wax can be used singly or in combination. It is preferable to use fine-crystalline carnauba wax having an acid value of 5 mg KOH/g or lower and a particle diameter of 1 μm when dispersed in a toner binder. Montan wax generally represents montan waxes refined from a mineral and is also preferably fine-crystalline with an acid value of from 5 to 14 mg KOH. Oxidized rice wax is obtained by air-oxidizing rice bran wax and preferably has an acid value of from 10 to 30 mgKOH/g. This is because these waxes are suitably finely-dispersed in a toner binder resin for use in the present disclosure so that it is easy to manufacture a toner having a good combination of offset resistance, transfer property and durability.

These waxes can be used alone or in combination.

Other known releasing agents such as solid silicone wax, higher aliphatic acid higher alcohols, montan-based ester wax, polyethylene wax, and polypropylene wax can be mixed for use.

There is no specific limit to the melting point of the releasing agent. The melting point thereof is preferably from 40° C. to 120° C. and more preferably from 70° C. to 90° C. When the melting point of the releasing agent is too low, the high temperature preservability the toner tends to deteriorate. In contrast, when the melting point is too high, a cold offset problem, i.e., an offset phenomenon that occurs at a low fixing temperature, tends to occur.

For example, the melting point of the releasing agent can be obtained as follows: raise the temperature of a sample of the releasing agent to 200° C. by a differential scanning calorimeter (DSC 210, manufactured by SEICO Electronics industrial Co., Ltd.), cooling down the sample at a temperature descending speed of 10° C./minute, and raising the sample at a temperature rising speed of 10° C./minute to obtain the maximum peak temperature of the melting heat as the melting point.

The releasing agent preferably has a melt viscosity of from 5 to 1,000 cps and more preferably from 10 to 100 cps as the measuring value at 20° C. higher than the melting point of the releasing agent. When the melt viscosity is too low, the releasing property tends to deteriorate. When the melt viscosity is too high, the effect of improving the hot offset resistance and low temperature fixing property tends to be not obtained.

The content of the releasing agent in the toner is preferably from 1 to 20% by weight and more preferably from 3 to 30% based on the toner resin component. When the content is too low, the offset resistance tends to be low. When the content is too high, the transferability and the durability tend to deteriorate.

The releasing agent can be introduced by a method of mixing and kneading a releasing agent inside resin, a method of dispersing or dissolving a releasing agent in monomer droplets or a solvent for a chemical toner formed by such as a dissolution suspension method, emulsification polymerization method, a method of introducing a releasing agent dispersed in water in particles by agglomeration, and a method of chemically adding a releasing agent to the surface of particles.

Charge Control Agent

The toner may contain a charge control agent to impart a suitable charging power.

Any known charge control agent can be suitably used. Since a colored material may affect the color tone, materials close to colorless or white are preferable.

Specific examples thereof include, but are not limited to, triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives. These can be used alone or in combination.

Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, and a quaternary ammonium group.

The charge control agent can be dissolved or dispersed with complex master batch including a coloring agent and a resin after melting and kneading, directly added to the organic solvent specified above with each component of the toner described above, or fixed to the surface of the toner after manufacturing toner particles. Among these, a method of imparting a fluorine-containing quaternary ammonium salt (charge control agent) to the particle surface is preferably used.

Although the content of the charge control agent is determined by the kind of the binder resin and the toner manufacturing method including the dispersion method and is not unambiguously limited, the content is preferably from 0.01% to 5% by weight and more preferably from 0.02% or 2% by weight based on the binder resin.

When the content is too large, the toner tends to have a large chargeability, thereby reducing the effect of the charge control agent, increasing the attraction of electrostatic force, which leads to deterioration of fluidity of a development agent containing the toner and the reduction of the image density. When the content is too small, the rise of charging or the amount of charge tends to be insufficient, thereby having an adverse impact on the image quality.

Form Irregulating Agent

The toner may contain a form irregulating agent to obtain a toner particle having an irregular form.

There is no specific limit to the selection of the form irregulating agent but it preferably has a layered inorganic compound in which at least part of ions between layers of the layered inorganic compound are modified by an organic ion. A compound having a smectite-based basic crystalline structure which is modified by an organic cation is preferable as the modified layered inorganic compound. Moreover, metal anion can be introduced by substituting part of divalent metals of the layered inorganic compound with tri-valent metals. However, a layered inorganic compound to which a metal anion is introduced has a high hydrophilicity so that modifying at least part of the metal anion therein by an organic anion is preferable.

Specific examples of organic cation modifiers for the modified layered inorganic compound include, but are not limited to, quaternary alkyl ammonium salts, phosphonium salts, and imidazolium salts. Among these, quaternary alkyl ammonium salts are preferable. Specific examples of the quaternary alkyl ammonium salts include, but are not limited to, trimethyl stearyl ammonium, dimethyl stearyl benzyl ammonium, and oleylbis(2-hydroxyethyl)methyl ammonium.

Specific examples of the organic anion modifiers include, but are not limited to, sulfates, sulfonates, carbonates, or phosphates having a cyclic alkyl (C1 to C44), an alkenyl (C1 to C22), alkoxy (C8 to C32), hydroxyalkyl (C2 to C22), ethylene oxide, propylene oxide, etc. Among these, carboxylic acids having an ethylene oxide skeleton are preferable.

By modifying at least part of the layered inorganic compound by an organic anion, the oil phase containing the toner composition with a suitable hydrophobicity has a non-Newtonian viscosity to irregulate the form of the toner.

The content of the layered inorganic compound in the toner composition part of which is modified by an organic ion is preferably from 0.05 to 10% by weight and more preferably from 0.05 to 5% by weight.

Specific examples of the modified layered inorganic mineral include, but are not limited to, montmorillonite, bentonite, hectorite, attapulgite, sepiolite, and mixtures thereof. Among these, organic modified montmorillonite and bentonite are preferable because of no adverse impact on the toner characteristics, easy viscosity adjustment, and a small addition amount.

Specific examples of the marketed products of the layered inorganic compounds part of which is modified by an organic cation include, but are not limited to, quaternium 18/bentonite such as Bentone 3, Bentone 38 (both manufactured by RHEOX INTERNATIONAL INCORPORATED), Thixogel VP (manufactured by united catalyst), Claytone 34, Claytone 40, and Claytone XL (manufactured by Southern Clay Products, Inc.); stearalconium bentonite such as Beotone 27 (manufactured by RHEOX INTERNATIONAL INCORPORATED), Thixogel LG (manufactured by united catalyst), Claytone AF and Claytone APA (manufactured by Southern Clay Products, Inc.); and quaternium 18/benzalconium bentonite such as Claytone HT and Claytone PS (manufactured by Southern Clay Products, Inc.). Among these, Claytone AF and Claytone APA are particularly preferable. A particularly preferred layered inorganic compound is a compound obtained by modifying DHT-4A (manufactured by Kyowa Chemical Industry Co., Ltd.) with an organic anion represented by the following chemical structure 1. A specific example of the compound represented by the chemical structure 1 is HITENOL 330T (manufactured by Dai-ichi Kogyo Seiyaku Co., Ltd.).

$R^1(OR^2)_nOSO_3M$ Chemical structure 1

In the chemical structure 1, $R^1$ represents an alkyl group having 13 carbon atoms and $R^2$ represents an alkylnene group having 2 to 6 carbon atoms.

n represents an integer of from 2 to 100 and M represents a monovalent metal element.

External Additive

The toner of the present disclosure may contain various kinds of external additives to improve the fluidity, control the amount of charge, and adjust the electric characteristics. There is no specific limit to the external additives and any known additives can be suitably used. Specific examples thereof include, but are not limited to, hydrophobized silica particulates, metal salts of aliphatic acid (e.g., zinc stearate, aluminum stearate), metal oxides (e.g., titania, tin oxide, antimony oxide), hydrophobized compounds thereof, and fluoropolymers thereof. Among these, hydrophobized silica particulates and titania (including hydrophobized titania particulates) are preferable.

Specific examples of the hydrophobized silica particulates include, but are not limited to, HDK H2000, HDK H2000/4, HDK H2050 EP. HVK21, HDK H1303 (all manufactured by Hoechst AG), R972, R974, RX200, RY200, R202, R805, and R812 (all manufactured by Nippon Aerosil Co., Ltd.), and H2000 (manufactured by Clariant (Japan) K.K.). Specific examples of the titania particulates include, but are not limited to, P-25 (manufactured by Nippon Aerosil Co., Ltd.), STT-30 and ST-65C-S (all manufactured by Titan Kogyo Ltd.), TAF-140 (manufactured by Fuji Titanium Industry Co., Ltd.), and MT-150W, MT-500B, MT-600B, MT-150A (manufactured by Tayca Corporation).

Specific examples of the titanium oxide particulates include, but are not limited to, T-805 (manufactured by Nippon Aerosil Co., Ltd.), STT-30A and STT-65S-S (all manufactured by Titan Kogyo Ltd.), TAF-500T and TAF-1500T (all manufactured by Fuji Titanium Industry Co., Ltd.), MT-100S and MT-100T (manufactured by Tayca Corporation), and IT-S (manufactured by ISHIHARA SANGYO KAISHA, LTD.)

These hydrophobized silica particulates, hydrophobized titanium particulates, and hydrophobized alumina particulates are obtained by treating hydrophilic particulates with a silane coupling agent such as methyltrimethoxy silane, methyltriethoxy silane, and octyltrimethoxy silane. Specific examples of the hydrophobizing agents include, but are not limited to, silane couling agents such as dialkyl dihalogenated silane, triaryl halogenated silane, alkyl trihalogenated sialne, and hexaalkyl disilazane; silylazing agents, silane coupling agents having a fluorinated alkyl group, organic titanate containing coupling agents, aluminum containing coupling agents, silicone oil, and silicone varnish. In addition, silicone oil treated inorganic particulates obtained by inorganic particulates with silicone oil with optional heating.

Specific examples of such inorganic particulates include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Among these, silica and titanium dioxide are particularly preferred.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

The inorganic particulate preferably has an average primary particle diameter of from 1 nm to 100 nm, and more preferably from 3 nm to 70 nm. When the average particle diameter is too small, the inorganic particulates tend to be embedded into toner particles, thereby preventing demonstration of the power of the inorganic particulates. When the average particle diameter is too large, the inorganic particulates tend to damage the surface of a latent electrostatic image. Inorganic particulates and hydrophobized inorganic particulates can be used in combination as the external additives. The hydrophobized primary particle preferably has an average particle diameter of from 1 nm to 100 nm, and more preferably from 5 nm to 70 nm. In addition, it is preferred to contain at least two kinds of inorganic particulates having an average primary particle diameter of 20 nm or less and at least one kind of inorganic particulates having an average primary particle diameter of 30 nm or greater. Moreover, the specific surface area of such inorganic particulates measured by the BET method is preferably from 20 to 500 $m^2/g$.

The addition amount of the external additive is preferably from 0.1 to 5% by weight and more preferably from 0.3 to 3% by weight based on the toner.

Resin particulates can be added as the external additive. Specific examples thereof include, but are not limited to, polystyrene particles obtained by prepared by a soap-free emulsion polymerization method, a suspension polymerization method or a dispersion polymerization method, copolymer particles of methacrylates and acrylates, polycondensation particles of silicone resins, benzoguanamine, nylon and the like, and polymer particulates of thermal curing resin. A combinational use of these resin particulates improves the chargeability of the toner and reduces the number of reversely-charged toner, thereby decreasing the background fouling. The content of the resin particulates is preferably from 0.01% to 5% by weight, and more preferably from 0.1% to 2.0% by weight based on the total weight of the toner.

There is no specific limit to the composition that may be obtained in the toner of the present disclosure. For example, fluidizers, cleaning property improver, magnetic material, metal soap, etc. can be suitably used.

Fluidizer

The fluidizer is obtained by surface-treatment and improves the hydrophobic property and prevents deterioration of the fluidity and the chargeability in a high moisture environment. Specific examples thereof include, but are not limited to, silane coupling agents, silylating agents, silane coupling agents including a fluoroalkyl group, organic titanate coupling agents, aluminum coupling agents, silicone oils, and modified silicone oils. It is preferable to use silica and titanium oxide described above after they are surface-treated by such a fluidizer.

Cleaning Property Improver

The cleaning property improver is added to the toner to remove the development agent containing the toner remaining on an image bearing member such as a photoreceptor and a primary transfer medium after transfer of the toner. Specific examples of the cleaning property improvers include, but are not limited to, zinc stearate, calcium stearate, and metal salts of aliphatic acid such as steraric acid; and polymer particulates such as polymethyl methacrylate particulates and polystyrene particulates, which are prepared by a soap-free emulsion polymerization method. The polymer particles preferably have a narrow particle size distribution with a volume average particle diameter of from 0.01 μm to 1 μm.

Magnetic Material

There is no specific limit to the selection of the magnetic material. Specific examples thereof include, but are not limited to, iron powder, magnetite, and ferrite. Among these, white magnetic material is preferable in terms of the color tone.

Method of Manufacturing Toner

There is no specific limit to the method of manufacturing the toner. Specific examples thereof include, but are not limited to, pulverization methods agglomeration methods, dissolution suspension method, a method of dissolving and/or dispersing a toner material in an organic solvent, dispersing and/or emulsifying the solution or the liquid dispersion in an aqueous medium in which resin particulates are dispersed followed by removing the organic solvent, a method of dissolving a toner material in a solvent and removing the solvent followed by pulverization, and a fusion spraying method.

In the pulverization method, for example, mother toner particles are obtained by fusing and/or mixing and kneading, pulverizing, and classifying a toner material.

In the case of the pulverization method, the form of the mother toner particles can be adjusted by imparting mechanical force to improve the average circularity of the toner. The mechanical force can be imparted to the mother toner particles using a device such as a hybridizer and a Mechanofusion.

In the mixing and kneading, a toner material containing the first binder resin A, the second binder resin B, a coloring agent, a releasing agent, etc. is mixed and the resultant mixture is placed in a fusion mixing and kneading machine for fusion and mixing and kneading. One-axis or two axis continuous mixing and kneading machines or batch type mixing and kneading machines can be used as the fusion mixing and kneading machine. Specific examples thereof include, but are not limited to, KTK type two axis extruders (manufactured by KOBE STEEL., LTD.), TEM type extruders (manufactured by TOSHIBA MACHINE CO., LTD), two axis extruders (manufactured by KCK), PCM type two-axis extruders (manufactured by Ikegai Corp.), and Ko-kneaders manufactured by Buss). The melting and mixing and kneading operations are preferably conducted under suitable conditions in which the molecular chain of the binder resin is not severed. To be specific, the temperature in the melting and mixing and kneading operation is determined referring to the softening point of the binder resin. When the temperature is too low relative to the softening point, the molecular chain tends to be severely severed. When the temperature is too high relative to the softening point, dispersion tends not to proceed soon.

In the pulverization, the obtained kneaded mixture is pulverized. In this pulverization, it is preferred that the kneaded mixture is coarsely-pulverized followed by fine pulverization. In this process, kneaded materials are pulverized by collision with a collision board in a jet stream, collision among particles in a jet stream, and pulverization at narrow gaps between a stator and a rotor that is mechanically rotating, etc.

In the classification, the obtained pulverized material is classified to obtain toner particles having a desired particle diameter. The classification can be conducted using a cyclone, a decanter, or a centrifugal to remove fine particles therefrom.

After the pulverization and the classification, the pulverized material is classified in the air stream by centrifugal, etc. to manufacture mother toner particles having a desired particle diameter.

The resin particulates c formed of the third binder resin C can be attached to the surface of the mother toner particles by a device such ad a hybridizer, a mechanofusion, etc., if desired.

Optionally, the external additive mentioned above can be coated on the surface of the mother toner particle by a Henschel mixer, etc.

In the agglomeration method, a liquid dispersion of particulates of the first binder resin A and the second binder resin B is prepared.

Separately, a dispersion body in which a coloring agent, a releasing agent, etc. are dispersed in an aqueous medium is prepared and agglomerated to a toner size after mixing followed by thermal fusion bonding to obtain mother toner particles. Thereafter, resin particulates formed of the third binder resin are attached to the surface of the mother toner particles by wet treatment followed by a wet treatment of inorganic particulates described later.

Among these, the method of dissolving and/or dispersing a toner material in an organic solvent, dispersing and/or emulsifying the solution or the liquid dispersion in an aqueous medium in which resin particulates are dispersed followed by removing the organic solvent is preferable because it has a wide selection of resins and good granularity and adjustment of the particle diameter, the particle size distribution, and the form is easy. That is, it is preferable to use a method (manufacturing method 1) of dissolving and/or dispersing a toner material containing a compound A1 having an active hydrogen group, a resin A2 having a portion reactive with the compound A1, the second binder resin B, a coloring agent, and a releasing agent, etc. in an organic solvent, dispersing and/or emulsifying the solution or liquid dispersion in an aqueous medium in which resin particulates c formed of the third binder resin C are dispersed, and removing the organic solvent in the middle of or after the cross-linking reaction and/or the elongation reaction of the compound A1 having an active hydrogen group and the resin A2 having a portion reactive with the compound A1.

In the manufacturing method 1, an organic solvent such as acetone and methylethylketone miscible with water among the organic solvents described later can be contained in the aqueous medium. Any miscible organic solvent that does not prevent granulation of resin particulates can be suitably used and there is no specific limit to the content of the miscible organic solvent as long as granulation of resin particulates is not prevented. For example, it is preferable that the total mass of water and the miscible organic solvent is 40% by weight or less and the miscible organic solvent does not remain in the resin particulates after drying.

Organic Solvent

Specific examples of the organic solvents to dissolve and/or disperse the toner material in the manufacturing method 1 include, but are not limited to, aromatic hydrocarbon-based solvents such as toluene, xylene, ethyl benzene, and tetraline, aliphatic or alicyclic hydrocarbon-based solvents such as n-hexane, n-heptane, and mineral spirit cyclohexane, halogen-based solvents such as methyl chloride, methyl bromide, methyl iodide, methylene dichloride, tetracholocarbon, trichloroethylene, and perchloroethylene, ester-based or ester ether-based solvents such as ethylacetate, butyl acetate, methoxybutyl acetate, methylcellosolve acetate, and ethylcellosolve acetate, ether-based solvents such as diethylether, tetrahydrofuran dioxane, ethylcellosolve, butylcellosolve, and propylene glycol monomethyl ether, ketone-based solvents such as acetone, methylethyl ketone, methylisobutyl ketone, di-n-butylketone, and cyclohexanone, alcohol-based solvents such as methanol, ethanol, n-propanol, isopropanol, n-butanol, isobutanol, t-butanol, 2-ethylhexyl alcohol, and benzyl alcohol, amide-based solvents such as dimethylformamide, and dimethylacetamide, suofoxide-based solvents such as dimethylsulfoxide, heteriocyclic compound-based solvents such as N-methylpyrrolidone.

Emulsifier or Dispersant

In the manufacturing method 1, an emulsifier or a dispersant can be used to emulsify and/or disperse the composition of the toner material. Any known surface active agent, water-soluble polymers, etc. can be used as the dispersant or the emulsifier. In addition, the organic solvent described above and a plasticizer can be used in combination with a helping agent for emulsification and dispersion. There is no specific limit to the surface active agent. For example, anionic surface active agents, cationic surface active agents, nonionic surface active agents, and ampholytic surface active agents can be preferably used. These surface active agents can be used alone or in combination. Specific examples of the surface active agents include, but are not limited to, the following.

Anion Surface Active Agent

Specific examples of the anion surface active agents include, but are not limited to, carboxylic acids and their salts, salts of sulfuric acid ester, salts of carboxylic methylated compounds, salts of sulfonic acid, and salts of esters of phosphoric acid.

Specific examples of the carboxylic acids include, but are not limited to, saturated or unsaturated aliphatic acids having 8 to 22 carbon atoms and their salts such as capric acid, lauric acid, myristic acid, palmitic acid, stearic acid, arachidic acid, behenic acid, oleic acid, linolic acid, ricinolic acid, higher aliphatic acid obtained by mixtures of saponifying palm oil, palm kernel oil, rice bran oil, and beef fat, and mixtures thereof.

Specific examples of the salts of carboxylic acids include, but are not limited to, sodium salt, potassium salts, amine salts, ammonium salts, quaternary ammonium salts, and alkanol amine salts (e.g., monoethanol amine salts, diethanol amine salts, and triethanol amine salts).

Specific examples of salts of sulfuric acid ester of anion surface active agents include, but are not limited to, salts of esters of a higher alcohol and sulfuric acid (salts of sulfuric acid ester of aliphatic alcohol having 8 to 18 carbon atoms), salts of higher alkylether sulfuric acid ester (adducts of salts of sulfuric acid ester with 1 to 10 mols of EO or PO of aliphatic alcohols having 8 to 18 carbon atoms), sulfuric acidated oils (obtained by neutralizing natural unsaturated fat or unsaturated wax having 12 to 50 carbon atoms with sulfuric acid), esters of sulfuric acidated aliphatic acid (obtained by neutralizing an ester of a lower alcohol having 1 to 8 carbon atoms of an unsaturated aliphatic acid having 6 to 40 carbon atoms with sulfuric acid), and sulfuric acidated olefins (obtained by neutralizing an olefin having 12 to 18 carbon atoms with sulfuric acid). Specific examples of the salts of sulfuric acid esters include, but are not limited to, sodium salt, potassium salts, amine salts, ammonium salts, quaternary ammonium salts, and alkanol amine salts (e.g., monoethanol amine salts, diethanol amine salts, and triethanol amine salts).

Specific examples of salts of esters of a higher alcohol and sulfuric acid include, but are not limited to, salts of esters of octyl alcohol and sulfuric acid, salts of esters of decyl alcohol and sulfuric acid, salts of esters of lauryl alcohol and sulfuric acid, salts of esters of stearyl alcohol and sulfuric acid, salts of esters of alcohol (e.g., product name: ALFOL 1214: manufactured by CONDEA Vista Chemical Company) obtained by synthesis by using Ziegler catalyst and sulfuric acid, and salts of esters of alcohol (e.g., product name: Diadol 115, 115H, and 135, manufactured by Mitsubishi Chemicals Corporation, Tridecanol, manufactured by Kyowa Hakko Kirin Co., Ltd., anol 23, 25, 45, and Oxocol 1213, 1215, and 1415, manufactured by Nissan Chemicals Industries, Ltd.) obtained by oxo method and sulfuric acid. Specific examples of the salts of esters of a higher alkyl ethersl and sulfuric acid include, but are not limited to, salts of esters of sulfuric acid of adducts of lauryl alcohol with 2 mol of EO, and salts of esters of sulfuric acid of adducts of octyl alcohol with 3 mol of EO. Specific examples of the sulfuric acidated oils include, but are not limited to, salts of sulfates of castor oil, oil of peanut, olive oil, rapeseed oil, beef fat, and mutton suet.

Specific examples of the esters of sulfuric acidated aliphatic acid include, but are not limited to, salts of sulfates of butyl oleate and butyl ricinoleate.

Specific examples of the carboxymethylated salts include, but are not limited to, salts of carboxymethylated compounds of aliphatic alcohol having 8 to 6 carbon atoms and salts of carboxymethylated compounds of adducts of alophatic alcohol having 8 to 16 carbon atoms with 1 to 10 mols of EO or PO, Specific examples of the carboxymethylated salts include, but are not limited to, salts of octyl alcohol carboxymethyl ichsodium, salts of lauryl alcohol carboxy methylated sodium, salts of carboxymethylated sodium of dovanol 23, and salts of tridecanol carboxymethylated ichisodium. Specific examples of the carboxymethylated salts include, but are not limited to, salts of octyl alcohol carboxymethyl ichsodium, salts of lauryl alcohol carboxy methylated sodium, salts of carboxymethylated sodium of dovanol 23, and salts of tridecanol carboxymethylated ichisodium.

Specific examples of the salts of sulfonic acid include, but are not limited to, salts of alkylbenzene sulfonic acid, salts of alkylnaphthalene sulfonic acid, salts of diesters of sulfosuccinic acid, and salts of sulfonic acid of Igepon T and its aromatic ring containing compound. A specific example of the salts of alkylbenzene sulfonic acid is dodecyl benzene sodium sulfonate. A specific example of the salts of alkylnaphthalene sulfonic acid is dodecyl naphthalene sodium sulfonate. A specific example of the salts of diesters of sulfosuccinic acid is sulfosuccinic acid di-2-ethylhexyl ester sodium.

Specific examples of the salts of sulfonic acid of aromatic ring containing compound include, but are not limited to, salts of mono- or di-sulfonic acid alkylated diphenyl ether and salts of styrenated phenol sulfonic acid.

Specific examples of the salts of esters of higher alcohol phosphoric acid and salts of phosphoric acid esters of higher alcohols and salts of phosphoric acid esters of adducts of higher alcohols with EO. Specific examples of the salts of phosphoric acid esters of higher alcohol include, but are not limited to, disdium salts of monoester of phosphoric acid of lauryl alcohol and sodium salts of dietsters of phosphoric acid of lauryl alcohol.

A specific example of the salts of phosphoric acid esters of adducts of higher alcohols with EO is oleyl alcohol Cationic Surface Active Agent Quaternary ammonium salt type surface active agents, aurin salt type surface active agents, etc. can be suitably used as the cationic surface active agent.

The quaternary ammonium salt type surface active agents can be obtained by a reaction between a tertiary amine having 3 to 4 carbon atoms and a quaternizing agent (e.g., alkylizing agents such as methylchloride, methyl bromide, ethyl chloride, benzyl chloride, and dimethyl sulfate and EO). Specific examples thereof include, but are not limited to, lauryl trimethyl ammonium chloride, didecyl dimethyl ammonium chloride, dioctyl dimethyl ammonium bromide stearyl trimethyl ammonium bromide, lauryl dimethyl benzyl ammonium chloride (benzalkonium chloride), cetyl pyridinium chloride, polyoxyethylene trimethyl ammonium chloride, and stearamide ethyldiethylmethyl ammonium methsulfate.

The amine type surface active agents is obtained by neutralizing a primary, secondary, or tertiary amine with an inorganic acid (hydrochloric acid, nitric acid, sulfuric acid, hydroiodic acid, phosphoric acid, and perchloric acid) or an organic acid (acetic acid, formic acid, gelatin acid, lactic acid, gluconic acid, adipic acid, alkyl phosphoric acid having 2 to 24 carbon atoms, malic acid, and citric acid).

Specific examples of the primary amine type surface active agents include, but are not limited to, inorganic acid salts or organic aid salts of aliphatic higher amines having 8 to 40 carbon atoms (e.g., lauryl amine, stearyl amine, cetyl amine, hydrogenerated beef fat amine, rosin amine) and salts of higher aliphatic acids (having 8 to 40 carbon atoms such as stearic acid, oleic acid) of lower amines (having 2 to 6 carbon atoms).

Specific examples of the secondary amine type surface active agents include, but are not limited to, inorganic acid salts or organic acid salts of adducts of aliphatic amine having 4 to 40 carbon atoms with EO. Specific examples of the tertiary amine type surface active agents include, but are not limited to, adducts of aliphatic amines having 4 to 40 carbon atoms (e.g. triethylamine, ethyleimethyla amine, N,N,N',N'-tetramethylethylene diamine), adducts of aliphatic amines (having 2 to 40 carbon atoms) with 2 or more mols of EO, alicyclic amined having 6 to 40 carbon atoms (N-methylpyrrolidine, N-methyl piperidine, N-methyl hexamethylene imine, N-methyl morpholine, and 1,8-diazabicyclo(5,4,0)-7-undecene), inorganic acid salts or organic acid salts of nitrogen-containing heterocyclic aromatic amines (4-eimthylamino pyridine, N-methylimidazole, and 4,4-dipyridyl), and inorganic acid salts or organic acid salts of tertiary amines such as tirethanol amine monostearate and stearamide ethyl diethyl methyl etanol amine).

Ampholytic Surface Active Agent

For example, carboxylic acid type ampholytic surface active agents, sulfuric acid ester type ampholytic surface active agents, sulfonic acid salt type ampholytic surface active agents, and phosphoric acid ester type ampholytic surface active agents can be used as ampholytic surface active agents.

Specific examples of the carboxylic acid type ampholytic surface active agents include, but are not limited to, amino acid type ampholytic surface active agents, betaine type ampholytic surface active agents, and imidazoline type ampholytic surface active agents. The amino acid type ampholytic surface active agents include amino groups and carboxylic acid groups in one molecular. A specific example thereof is represented by the following chemical structure 2.

$$[R—NH—(CH_2)_n—COO]_mM \qquad \text{Chemical structure 2}$$

In the chemical structure 2, R represents a monovalent hydrocarbon. n and m independently represent 1 or 2. M represents a hydrogen ion, an alkali metal ion, an alkali earth metal ion, ammonium cation, amine cation, and alkanol amine cation.

Specific examples of the ampholytic surface active agents represented by the chemical structure 3 include, but are not limited to, alkyl (having 6 to 40 carbon atoms) aminopropion acid type ampholytic surface active agents such as stearyl aminopropion acid sodium, lauryl amino propion acid sodium, alkyl (having 4 to 24 carbon atoms) amino acetic acid type ampholytic surface active agents such as lauryl amino acetic acid sodium.

A molecule of the betaine type ampholytic surface active agent contains a cation portion of the quaternary ammonium salt type and an anion portion of the carboxylic acid type. Specific examples thereof include, but are not limited to, alkyl (having 6 to 40 carbon atoms) dimethyl betaines (stearyl dimethyl amino acetic acid betaine and lauryl dimethyl amino acetic acid betaine), amide betaines having 6 to 40 carbon atoms such as palm oil aliphatic acid amide propyl betaine), alkyl (having 6 to 40 carbon atoms) dihydroxyalkyl (having 6 to 40 carbon atoms) betaine such as lauryl dihydroxyethyl betaine).

A molecule of the imidazoline type ampholytic surface active agent contains a cation portion of the imidazoline ring and an anion portion of the carboxylic acid type. A specific example thereof is 2-undecyl-N-carboxymethyl-N-hydroxyethylimidazolium betaine.

Specific examples of other ampholytic surface active agents include, but are not limited to, glycine type ampholytic surface active agents such as lauroyl glycine sodium, lauryl diaminoethyl glycine, lauryl diamino ethyl glycine hydrochloric acid salts, and dioctyl diamino ethylglycine hydrochloric acid salts; sulfobetaine type ampholytic surface active agents such as pentadecylsulfotaurine; sulfosalt type ampholytic surface active agents; and phosphoric acid ester salt type ampholytic surface active agents.

Non-Ion Surface Active Agent

Adducts with AO adduct type non-ion surface active agents and polyalcohol type non-ion surface active agents are used as the non-ion surface active agents.

The AO adduct type non-ion surface active agents are obtained by directly adding an AO (having 2 to 20 carbon atoms) to a higher alcohol having 8 to 40 carbon atoms, a higher aliphatic acid having 8 to 40 carbon atoms, an alkyl amine having 8 to 40 carbon atoms, etc., reacting a polyalkylene glycol obtained by adding an AO to a glycol with a higher aliphatic acid, adding an AO to an esterified compound obtained by reacting a higher alcohol with a higher aliphatic acid, or adding an AO to a higher aliphatic amide.

Specific examples of AOs include, but are not limited to, EOs, POs, or BOs. Among these, EOs and adducts of random or blocked EOs and POs. The number of mols of AO is preferably 10 to 50 mols. Among these AOs, AOs containing EO in an amount of from 50 to 100% are preferable.

Specific examples of the AO adduct type non-ion surface active agents include, but are not limited to, oxyalkylene alkyl ether (alkylene having 2 to 24 carbon atoms and alkyl having 8 to 40 carbon atoms)(e.g., adducts of octyl alcohol with 20 mols of EO, adducts of lauryl alcohol with 20 mols of EO, adducts of stearyl alcohol with 10 cools of EO, adducts of oleyl alcohol with 5 mols of EO, and blocked adducts of lauryl alcohol with 10 mols of EO and 20 mols of PO); polyoxyalkylene higher aliphatic acid ester (alkylnene having 2 to 24 carbon atoms and a higher aliphatic acid having 8 to 40 carbon atoms)(e.g., adducts of stearyl acid with 10 mols of EO and adducts of lauryl acid with 10 mols of EO); polyoxyalkylene polyalcohol higher aliphatic acid ester (alkylene having 2 to 24 carbon atoms, polyalcohols having 3 to 40 carbon atoms, higher aliphatic acid having 8 to 40 carbon atoms)(e.g., lauric acid diester of polyethylene glycol with a polymerization degree of 20, and oleic acid diester of polyethylene glycol with a polymerization degree of 20; polyoxy alkylene alkyl phenyl ether (alkylene having 2 to 24 carbon atoms, alkyl having 8 to 40 carbon atoms)(e.g., adducts of nonyl phenol with 4 mols of EO, blocked adducts of nonyl phenol with 8 mols of EO and 20 mols of PO); polyoxyalkylene alkyl aminoether (alkylene having 2 to 24 carbon atoms, alkyl having 8 to 40 carbon atoms) (e.g. adducts of lauryl amine with 10 mols of EC and adduct of stearyl amine with 10 mols of EO); and polyoxyalkylene alkanol amide (alkylnene having 2 to 24 carbon atoms, amide (acyl portion) having 8 to 24 carbon atoms)(e.g., adducts of hydroxyethyl lauric acid amide with 10 mols of EO and adducts of hydroxypropyl oleic acid amide with 20 mols of EO).

Specific examples of the polyalcohol type non-ion surface active agents include, but are not limited to, polyalcohol aliphatic acid esters, adducts of polyalcohol aliphatic acid ester with AO, polyalcohol alkyl ethers, and adducts of polyalcohol alkyl ethers with AO. The polyalcohol has 3 to 24 carbon atoms, the aliphatic acid has 8 to 40 carbon atoms, and AO has 2 to 24 carbon atoms.

Specific examples of polyalcohol aliphatic acid esters include, but are not limited to, pentaerythritol monolaurate, pentaerythritol monooleate, sorbitan monolaurate, sorbitan monostearate, sorbitan dilaurate, sorbitan dioleate, and sucrose monostearate.

Specific examples of the adducts of polyalcohol aliphatic acid ester with AO include, but are not limited to, adducts of ethylene glycol monoleate with 10 mols of EO, adducts of ethylene glycol monostearate with 20 mols of EO, random adducts of tritrimethylol propane monostearate with 20 mols of EC and 10 mols of PO, adducts of sorbitane mononlaurate with 10 mols of EO, adducts of sorbitane distearate with 20 mols of EO, and random adducts of sorbitane di laurate with 12 mols of EO and 24 mols of PO.

Specific examples of the polyalcohol alkyl ethers include, but are not limited to, pentaetythritol monobutyl ether, pentaerythritol monolauryl ether, sorbitan monomethyl ether, sorbitan monostearyl ether, methyl glycoside, and lauryl glycoside.

Specific examples of the adducts of polyalcohol alkyl ethers with AO include, but are not limited to, adducts of sorbitan monostearyl ether with 10 molls with EO, random adducts of methyl clycoside with 20 mols of EO and 10 mols of PO, adducts of lauryl glycoside with 10 mols of EO, and random adducts of stearyl glycoside with 20 mols ow EO and 20 mols of PO.

Water-Soluble Polymer

Specific examples of the water-soluble polymers include, but are not limited to, cellulose compounds such as methyl cellulose, ethyl cellulose, hydroxyethyl cellulose, ethyl hydroxy ethyl cellulose, carboxymethyl cellulose, hydroxypropyl cellulose, and saponified compounds thereof; gelatine, starch, dextrin, gum arabic, chitin, chitosan, polyvinyl alcohol, polyvinylpyrrolidone, polyethylene glycol, polyethylene imine, polyacrylamide, acrylic acid containing polymers (salts) such as sodium polyacrylate, potassium polyacrylate, ammonium polyacrylate, partially neutralized sodium hydroxide of polyacrylate, and copolymers of sodium acrylate and acrylic acid ester, (partially) neutralized sodium hydroxide of copolymers of styrene and maleic anhydride, water-soluble polyurethane (reactive products of polyethylene glycol, polycaprolactone, etc. with polyisocyanate).

Although the elongation and/or cross-linking time depends on the combination of the reactive portion of the prepolymer A2 and the compound A1 having an active hydrogen group, it is from 10 minutes to 40 hours and preferably from 2 to 24 hours. The reaction temperature is from 0 to 150° C. and preferably from 40 to 98° C. In addition, any known catalyst can be optionally used.

Specific examples thereof include dibutyltin laurate, and dioctyltin laurate.

To remove the organic solvent from the obtained emulsified dispersion body, a method of gradually heating the entire system is employed to completely evaporate and remove the organic solvent in the droplets. Alternatively, the organic solvent can be evaporated and removed by spraying the emulsified dispersion body into a dry atmosphere so that non-water-soluble organic solvent in the droplets is removed and toner particulates are formed while evaporating and removing the aqueous dispersing agent. Specific examples of the dry atmosphere to which the emulsified dispersion body is sprayed include, but are not limited to, heated air, nitrogen, carbon-rich gas, combustion gas. In particular, various kinds of air streams heated to a temperature higher than the highest boiling point of the used solvents are used. These organic solvents can be removed by a spray drier, a belt drier, a rotary kiln, etc. in a short time.

Alternatively, such organic solvents can be removed by blowing air by a rotary evaporator, etc.

Thereafter, the resultant is subjected to centrifugal for coarse separation followed by repeating the processes of washing the emulsified dispersion body in a washing tank and drying by a heated air drier to remove the solvent. Subsequent to drying, mother toner particles are obtained.

Thereafter, optionally the mother toner particles are subjected to an aging process to control the hollow state inside the mother toner particles, which is preferable. It is more preferable to age the mother toner particles at a temperature ranging from 30 to 55° C. (more preferably from 40° C. to 55° C.) for 5 to 36 hours (more preferably from 10 to 24 hours).

When the thus prepared toner particles have and maintain a wide particle size distribution after the washing and drying treatment of the particles, the particle size distribution can be adjusted by a classification treatment to obtain a desired particle size distribution.

The classification treatment can be performed in a liquid dispersion using a cyclone, a decanter, or a centrifugal to remove fine particles therefrom. Classification treatment can be performed for powder of the toner particles obtained after drying but classification in the liquid including the particles is preferable in terms of the efficiency. Obtained toner particulates or coarse particles can be returned to the mixing and kneading process for reuse. Even wet toner particulates or coarse particles can be used.

Removing the dispersion agent from the liquid dispersion as much as possible is preferable, which is also preferable to conduct the classification process described above together.

Inorganic particulates such as hydrophobic silica fine powder can be admixed with the thus manufactured mother toner particles to improve the fluidity, the preservability, the development property, and the transfer property of the toner.

Although mixing of the additive is conducted by a typical powder mixer, a mixer having a jacket, etc. is preferable to control the internal temperature. To change the history of the burden applied to the additive, adding the additive in the midstream or little by little during mixing is suitable. It is also suitable to change the number of rotation, the rolling speed, the time, the temperature, etc. of the mixer. Heavy burden followed by relatively light burden or vice versa is applicable. Specific examples of the mixers include, but are not limited to, V-type mixers, Rocking mixers, Lodige mixers, Nautor mixers, and Henschel mixers. Thereafter, the resultant is screened by a screen having an opening of 250 meshes or more to remove coarse particles and agglomerated particles. Finally, the toner is obtained.

Although there is no specific limit to the form and the size of the toner, the toner preferably has the following average circularity, volume average particle diameter, the ratio (volume average particle diameter/number average particle diameter) of the volume average particle diameter to the number average particle diameter.

The average circularity represents a value obtained by dividing the circumference of a circle having the same projected area as that of the toner particle form with the circumference of the actual particle and is preferably from 0.900 to 0.980 and more preferably from 0.950 to 0.975.

Containing toner having an average circularity less than 0.94 in an amount of 15% or less is preferable. When the average circularity is too small, obtaining a good transfer property or an image without dust tends to be difficult. When the average circularity is too large, the cleaning performance on an image bearing member, a transfer belt, etc. tends to deteriorate in an image forming system employing a blade cleaning, etc., thereby causing fouling on an image such that toner that has formed an image having a high image area such as a photograph on the image bearing member is untransferred due to misfeeding of paper and remains and accumulates on the image bearing member, which causes background fouling. Alternatively, such remaining toner contaminates a charging roller to contact the image bearing member for charging. Therefore, the original charging power may not be demonstrated.

The average circularity is measured by a flow type particle size analyzer (FPIA-2100, manufactured by Sysmex Corporation) followed by analysis using a analysis software (FPIA-2100 Data Processing Program for FPIA version 00-10). To be specific, 0.1 to 0.5 ml of 10 wt % surface active agent (alkylbenzene sulfonate Neogen SC-A, manufactured by Daiichi Kogyo Co., Ltd.) is placed in a glass beaker (100 ml). 0.1 to 0.5 g of each toner is added in the beaker followed by stirring with a microspatula. 80 ml of deionized water is added to the mixture. The thus obtained liquid dispersion is subjected to dispersion treatment for three minutes by an ultrasonic wave dispersion device (manufactured by Honda Electronics). The form and the distribution of the toner is measured repeatedly by FPI!-2100 until the concentration of the liquid dispersion is from 5,000 to 15,000 particles/μl. The point of this measuring method is that the concentration of the liquid dispersion is from 5,000 to 15,000 particles/μl in terms of the measuring reproducibility.

It is necessary to change the condition of the liquid dispersion, i.e., the addition amount of the surface active agent and the toner to obtain the concentration of the liquid dispersion. The amount of the surface active agent varies depending on the hydrophobicity of the toner as in the measuring of the toner particle diameter. An excessively large amount of the surface active agent causes noise by foam and an excessively small amount is not sufficient to wet the toner particle, which leads to insufficient dispersion.

In addition, the addition amount of the toner changes depending on the particle diameter thereof. When a toner having a small particle diameter is used, the addition amount decreases. When a toner having a large particle diameter is used, the addition amount increases. When the toner particle diameter is from 3 to 10 μl, the concentration of the liquid dispersion can be adjusted within the range of from 5,000 to 15,000 particles/μl by adding 0.1 to 0.5 g of the toner. There is no specific limit to the volume average particle diameter of the toner. For example, the volume average particle diameter is preferably from 3 μm to 10 μm and more preferably from 3 μm to 8 μm. When the volume average particle diameter is too small, toner for use in a development agent containing the toner and carriers may be attached to the surface of carriers during agitation in a developing unit for an extended period of time, which may lead to the deterioration of the charging ability of the carrier. When the volume average particle diameter is too large, quality images with high definition tend to be not obtained easily and the particle diameter of the toner tends to significantly vary when the toner in the development agent is replenished.

The ratio (volume average particle diameter/number average particle diameter) of the volume average particle diameter to the number average particle diameter is preferably from 1.00 to 1.25 and more preferably from 1.10 to 1.25.

The volume average particle diameter and the ratio of the volume average particle diameter to the number average particle diameter are measured by a particle size measuring device (Multisizer III, manufactured by Beckman Coulter Co., Ltd.) with an aperture of 100 μm and analyzed by an analysis software (Beckman Coulter Multisizer 3 version 3.51). To be specific, 0.5 ml of 10 wt % surface active agent (alkylbenzene sulfonate Neogen SC-A, manufactured by Daiichi Kogyo Co., Ltd.) is placed in a glass beaker (100 ml). 0.5 g of each toner is added in the beaker followed by stirring with a microspatula. 80 ml of deionized water is added to the mixture. The thus obtained liquid dispersion is subject to dispersion treatment for 10 minutes by an ultrasonic wave dispersion device (W-113MK-II, manufactured by Honda Electronics). The liquid dispersion is measured by the Multisizer III using ISOTON® III (manufactured by Beckman Coulter Inc.) as the measuring solution. The toner sample liquid dispersion is dropped such that the concentration indicated by the measuring device is from 6 to 10%. In this measuring method, the point of this method is that the concentration is from 6 to 10% in terms of measuring reproducibility. The measured particle diameter does not have an error when the concentration is in that range.

Development Agent

The development agent of the present disclosure contains the toner described above and other suitably selected components such as carriers. The development agent can be a one-component development agent and a two-component development agent and the two-component development agent is preferable in terms of the length of the working life particularly when used in a high speed printer that meets the demand for high speed information processing of late.

When a one-component development agent is used and replenished a number of times, the variability of the particle diameter of the toner is small and filming of the toner on the developing roller as the development agent bearing member and fusion bonding of the toner onto members such as a blade for regulating the thickness of the toner layer, hardly occurs. Therefore, good and stable developability is sustained even when the development agent is used (stirred) for an extended period of time so that quality images having a good and stable developability can be produced. When a two-component development agent is used and replenished a number of times for an extended period of time, the variability of the particle diameter of the toner is small. In addition, good and stable developability is sustained even when the development agent is stirred in a development device for an extended period of time so that quality images can be stably produced.

Carrier

There is no specific limit to the selection of the carrier. A carrier is preferable which includes a core and a resin layer that covers the core.

Carrier Core Material

There is no specific limit to the core material of the carrier and any magnetic particles can be suitably used. Specific examples thereof include, but are not limited to, ferrite, magnetite, iron and nickel. In terms of the adaptivity to the environment recently particularly required, manganese ferrite, manganese-magnesium ferrite, manganese-strontium ferrite, manganese magnesium strontium ferrite, and lithium-based ferrite are suitable instead of typically used copper-zinc based ferrite in the case of ferrite.

In addition, to control the resistance of the core material and improve the manufacturing stability, at least one kind of other elements can be mixed as the composition of the core material. Specific examples of such elements include, but are not limited to, Li, Na, K, Ca, Ba, Y, Ti, Zr, V, Ag, Ni, Cu, Zn, Al, An, Sb, and Bi. The blend amount of these elements is preferably 5 atomic % or less and more preferably 3 atomic % or less based on the total weight of the metal elements.

Cpver Layer

The cpver layer contains at least a binder resin and optional components such as inorganic particulates.

Binder Resin

There is no specific limit to the binder resin that forms the cpver layer and any known resin can be suitably selected. Specific examples thereof include, but are not limited to, cross-linking copolymers including polyolefins (e.g., as polyethylene, polypropylene), modified products thereof, styrene, acrylic resins, acrylonitrile, vinyl acetate, vinylalcohol, vinylchloride, vinylcarbazole, and vinylether; silicone resins formed of organosiloxane bonding or modified products thereof (e.g., modified by alkyd resins, polyester resins, epoxy resins, polyuretheane, polyimides); polyamies; polyesters; polyurethanes; polycarbonates; urea resins; melamine resins; benzoguanamine resins; epoxy resins; ionomer resins; polyimide resins; and their derivatives, etc. These can be used alone or in combination. Among these, acrylic resins and silicone resins are particularly preferable.

Since the acrylic resin is strongly attached to particulates contained in the core material and the cpver layer and of low brittleness, the resin is excellent for peeling off of the cpver layer and stably maintains the cpver layer. Furthermore, it is possible to firmly hold the particulates such as electroconductive particulates contained in the cpver layer.

In particular, the resin is strongly effective to hold particles having a larger particle diameter than the thickness of the cpver layer.

The glass transition temperature of the acrylic resin is preferably from 20° C. to 100° C. and more preferably from 25° C. to 80° C. By having a glass transition temperature of the acrylic resin within this range, the binder resin is considered to have a suitable resilience and relieve the shock received by a carrier during triboelectric charging of the development agent, thereby reducing peeling-off and friction of the cpver layer.

In addition, it is preferable to use a cross-linked product of an acrylic resin and an amino resin as the binder resin forming the cpver layer because fusion bonding, referred to as blocking, which tends to occur when an acrylic resin is singly used can be prevented while maintaining a suitable resilience of the acrylic resin.

Any known amino resin can be suitably used. Among these, guanamine and melamine are preferably used because these can improve the charge imparting ability of a carrier.

In addition, guanamine and melamine can be used in combination with other amine resins to suitably control the charge imparting ability of a carrier. As the acrylic resin that can be cross-linked with such amino resins, an acrylic resin having a hydroxyl group or a carboxylic acid group is preferable and an acrylic resin having a hydroxyl group is more preferable. The attachability of the acrylic resin with the core material and the particulate can be furthermore improved by having a hydroxyl group. Also the dispersion of particulates is more stabilized. The hydroxyl group value is preferably 10 mgKOH/g or more and more preferably 20 mgKOH/g or more.

Furthermore, when the binder resin contains a silicone portion as the composition unit, the surface energy of the carrier surface tends to decrease, thereby reducing occurrence of toner spent. Therefore, the characteristics of the carrier are maintained for an extended period of time.

The composition units for the silicone portion preferably contains at least one of the methyltrisiloxane unit, the dimethyl disiloxane unit, and the trimethyl siloxane unit and can be blended or chemically bonded with other coating layer resin or form a laminate structure.

When blended or forming a laminate structure, it is preferable to use a silicone resin and/or modified products thereof. In particular, problems such as friction, abrasion, and detachment unique to silicone resin and other resins can be reduced by containing a silicone resin composition having a composition unit represented by the chemical structure 3.

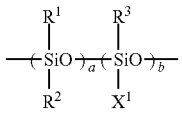

In the chemical structure 3, $R^1$ to $R^3$ independently represent hydrocarbon groups and/or their derivatives, $X^1$ represents a composition represented by a condensation reaction group, and "a" and "b" independently represent integers.

Specific examples of the condensation groups include, but are not limited to, a hydroxyl group, an alkoxy group, and a methylethyl ketoxym group. The condensation reaction occurs at each unit by moisture in the atmosphere or upon application of heat, thereby forming a three dimensional network structure.

Specific examples of the silicone resins include, but are not limited to, straight silicone resins only formed of organic siloxane bonding having the composition unit represented by the chemical structure 2, and silicone resins modified by an alkyd resin, a polyester resin, an epoxy resin, an acrylic resin, and a urethane resin.

Specific examples of the straight silicone resins include, but are not limited to, KR271, KR272, KR282, KR252, KR255, and KR152 (manufactured by Shin-etsu Chemical Co., Ltd.) and SR2400, SR2405, SR2406 (manufactured by Dow Corning Toray Co., Ltd.). In addition, specific examples of the modified silicone resins include, but are not limited to, epoxy modified resins (ES-1001N), acrylic resin-modified resin (KR-5280), polyester resin modified resins (KR-5203), alkyd resin modified resins (KR-206), urethane resin modified resins (KR-305) (all of which are manufactured by Shin-etsu Chemical Co., Ltd.), and epoxy resin modified resins (SR2115), alkyd resin modified resins (SR2110)(both are manufactured by Dow Corning Toray Co., Ltd.).

The silicone resins can be used alone and with a cross-linking reactive composition, charge amount control composition, etc. A specific example of the cross-linked reactive composition is a silane coupling agent.

Specific examples of the silane coupling agents include, but are not limited to, methyltrimethoxy silane coupling agents, methyltriethoxy silane coupling agents, octyltrimethocy silane coupling agents, and amino silane coupling agents.

Amino-Silane Coupling Agent

The liquid for the cpver layer optionally contains an amino silane coupling agents. The amount of charge of the carrier to the toner can be suitably controlled by the contained amino silane coupling agent. Specific examples of the amino-silane coupling agents include, but are not limited to, compounds represented by the chemical structures 4

$H_2N(CH_2)_3Si(OCH_3)_3$ MW 179.3

$H_2N(CH_2)_3Si(OC_2H_5)_3$ MW 221.4

$H_2NCH_2CH_2CH_2Si(CH_3)_2(OC_2H_5)$ MW 161.3

$H_2NCH_2CH_2CH_2Si(CH_3)(OC_2H_5)_2$ MW 191.3

$H_2NCH_2CH_2NHCH_2Si(OCH_3)_3$ MW 194.3

$H_2NCH_2CH_2NHCH_2CH_2CH_2Si(CH_3(OCH_3)_2$ MW 206.4

$H_2NCH_2CH_2NHCH_2CH_2CH_2Si(OCH_3)_3$ MW 224.4

$(CH_3)_2NCH_2CH_2CH_2Si(CH_3)(OC_2H_5)_2$ MW 219.4

$(C_4H_9)_2NC_3H_6Si(OCH_3)_3$ MW 291.6 Chemical structures 4

The content of the amino silane coupling agents is preferably from 0.001 to 30% by weight and more preferably 0.001 to 10% by weight based on the entire of the cpver layer. When the content is too small, the chargeability is easily affected by the environment and the yield tends to decrease. When the content is too large, the cpver layer tends to be brittle, thereby degrading the abrasion resistance of the cpver layer.

Particulate

The cpver layer optionally contains particulates. There is no specific limit to the particulates and any known particulates can be suitably selected. Specific examples thereof include, but are not limited to metal powder, inorganic particulates of tin oxide, zinc oxide, silica, titanium oxide, alumina, potassium titanate, barium titanate, aluminum borate, etc., and electroconductive polymers such as polyaniline, polyacetylaene, polyparaphenylene, poly(para-phenylene sulfide), and polypyrrol, parylene, and organic particulates such as carbon black. These can be used alone or in combination.

The particulates may have an electroconductively treated surface. Electroconductive treatment is conducted by a method of coating the surface of particulates with for example, aluminum, zinc, copper, nickel, silver, or alloys thereof, zinc oxide, titanium oxide, tin oxide, antimony oxide, indium oxide, bismuth oxide, indium oxide in which tin is doped, tinoxide in which antimony is doped, zirconium oxide, etc., by forming solid solution thereof or fusion-bonding. Among these, tin oxide, indium oxide, and indium oxide in which tin is doped are preferably used for the electroconductive treatment.

The particulate preferably has a volume average particle diameter of 1 μm or less. When the volume average particle diameter is excessively large, the particulate tends to be not held in the cpver layer, thereby reducing the strength of the cpver layer by detachment of the particulate, etc.

The volume average particle diameter of the particulate can be measured by, for example, particle size distributor employing a laser doppler or dynamic light scattering system.

The content ratio of the cpver layer in the carrier is preferably 5% by weight or more and more preferably from 5 to 10% by weight. The thickness of the cpver layer is preferably from 0.1 μm to 5 μm and more preferably from 0.3 μm to 2 μm.

The thickness of the cpver layer is obtained as the average as follows: manufacturing the cross-section of 50 carriers with, for example, Focused Ion Beam (FIB), observing the cross-sections with a transmission electron microscope (TEM) or a scanning transmission electron microscope (STEM), and calculating the average of the obtained thicknesses.

Method of Forming Carrier Cpver Layer

There is no specific limit to the method of forming the cpver layer for the carrier and any known methods can be used. For example, the cpver layer can be obtained by coating (spraying or dip-coating) the surface of the core material with a solution for the cpver layer in which materials including a binder resin and/or a precursor thereof is dissolved. It is preferable to apply the solution to the surface of the core material and heating the carrier on which the cpver layer is formed to promote the polymerization of the binder resin and/or the precursor thereof. In this method, subsequent to coating the cpver layer, the carrier can be heated in a coating device or with a typical heating device such as an electric furnace and baking kiln.

Although the heating temperature depends on the materials for the cpver layer and it is not possible to jump to any conclusion, it is preferably from around 120° C. to around 350° C. and particularly preferably equal to or lower than the decomposition temperature of the material.

The decomposition temperature of the material for the cpver layer is preferably around 220° C. or lower and the heating time is preferably around 5 minutes to 120 minutes.

Physical Properties of Carrier

The volume average particle diameter of the carrier is preferably from 10 μm to 100 μm and more preferably from 20 μm to 65 μm.

When the volume average particle diameter of the carrier is too small, carrier attachment ascribable to reduction of uniformity of the core particle tends to occur, which is not preferable. When the volume average particle diameter of the carrier is too large, the reproducibility of the fine portion of an image tends to deteriorate so that fine images are difficult to obtain, which is not preferable.

There is no specific limit to the method of measuring the volume average particle diameter and any device that can measure the particle size distribution can be suitably used. For example, microtrack particle size distributor (model HRA9320_X100, manufactured by Nikkiso Co., Ltd.) can be used for measurement.

The volume resistivity of the carrier is preferably from 9 [log (Ω·m)] to 16 [log (Ω·m)] and more preferably from 10 [log (Ω·m)] to 14 [log (Ω·cm)].

When the volume resistivity is too small, carrier attachment tends to occur to non-image portions, which is not preferable. When the volume resistivity is too large, the edge effect, which is the image density is emphasized in the edge portion when developed, tends to be significant, which is not preferable.

The volume resistivity can be arbitrarily adjusted by adjusting the thickness of the cpver layer of the carrier and the content of the electroconductive particulates mentioned above.

The method of measuring the volume resistivity is as follows: fill the carrier in a cell of a fluorine-containing vessel accommodating electrodes 1a and 1b having a surface area of 2.5 cm×4 cm with a gap therebetween of 0.2 cm; conduct tapping under the condition of a falling height of 1 cm, a tapping speed of 30 times/minutes, and the number of tapping times of 10 times; apply a DC voltage of 1,000 V between the electrodes; and measure the resistance r (Ω) at 30 seconds after the application with a high resistance meter 4329A (manufactured by 2011Hewlett-Packard Development Company, L.P.) to calculate the volume resistivity R [log (Ω·cm)] using the following relation.

$$R=\text{Log}\,[r\times(2.5\text{ cm}\times4\text{ cm})/0.2\text{ cm}]$$

When the development agent is a two-component development agent, the mixing ratio of the toner to carrier therein is preferably from 2.0 to 12.0% by weight and more preferably from 2.5 to 10.0% by weight.

Development Agent Container

The development agent of the present disclosure can be accommodated in a container for use.

There is no specific limit to the container and any known container can be suitably used. For example, a container having a housing and a cap is preferably used.

There is no specific limit to the size, form, structure, and material of the housing of the container and any known housing can be used. For example, a cylindrical form with spiral convexoconcave forms formed in the inner surface is preferable because the development agent as the content is transferred to the discharging mouth. In addition, part or entire of the spiral portions having an accordion function is particularly preferable.

There is no specific limit to the material of the housing of the development agent container. Any known resin can be suitably used. Among these, polyester resins, polyethylene resins, polypropylene resins, polystyrene resins, polyvinylchloride resins, polyacrylate resins, polycarbonate resins, ABS resins, and polyacetal resins are suitably used.

The development agent container is easy to preserve, transfer, and handle and detachably attachable to an image forming apparatus described later to supply the development agent thereto.

Image Forming Method and Image Forming Apparatus

The image forming method of the present disclosure includes a latent electrostatic image forming process, a development process, a transfer process, and a fixing process with optional processes such as a cleaning process, a discharging process, a recycling process, and a control process.

The image forming apparatus of the present disclosure includes a latent electrostatic image bearing member, a latent electrostatic image forming device, a development device, a transfer device, and a fixing device with optional devices such as a cleaning device, a discharging device, a recycling device, and a control device.

Latent Electrostatic Image Forming Process and Latent Electrostatic Image Forming Device The latent electrostatic image forming process is a process of forming a latent electrostatic image on a latent electrostatic image bearing member.

There is no specific limit to the (latent electrostatic) image bearing member (also referred to as photoreceptor or photoconductor) with regard to the material, form, structure, size, etc. and any known image bearing member can be suitably selected. An image bearing member having a drum form is preferred. Also, an inorganic image bearing member formed of amorphous silicone or selenium and an organic image bearing member formed of polysilane or phthalopolymethine are selected in terms of materials. Among these, amorphous silicon, etc. is preferred in terms of long working life.

Latent electrostatic images are formed by, for example, uniformly charging the surface of the image bearing member and irradiating the surface according to the obtained image information using the latent electrostatic image forming device.

The latent electrostatic image forming device includes at least a charger which uniformly charges the surface of the image bearing member, an irradiator which irradiates the surface of the image bearing member according to the obtained image information.

The surface of the image bearing member is charged by, for example, applying a voltage to the surface of the image bearing member with the charger.

There is no specific limit to the charger and any known charger can be selected. A known contact type charger having an electroconductive or semi-electroconductive roll, brush, film, rubber blade, etc. and a non-contact type charger such as a corotron or a scorotron which uses corona discharging can be used.

The charger is provided in contact with or in the vicinity of the image bearing member. A charger that applies a direct voltage optionally with an overlapped alternative voltage to the image bearing member is preferable to charge the surface thereof.

In addition, a charging roller that is provided in contact with the image bearing member via a gap tape therebetween and applies a voltage in which an alternative voltage is overlapped with a direct voltage is preferable to charge the surface of the image bearing member.

The irradiation is conducted by, for example, irradiating the surface of the image bearing member with the irradiator according to image data.

There is no specific limit to the irradiator if it can irradiate the surface of the charger image bearing member according to the obtained image information. Specific examples of such irradiators include, but are not limited to, a photocopying optical system, a rod lens array system, a laser optical system, and a liquid crystal shutter optical system.

As to the present disclosure, the rear side irradiation system in which an image bearing member is irradiated from the rear side thereof can be also employed.

Development Process and Development Device

The development process is a process of forming a visual image by developing the latent electrostatic image with the development agent described above of the present disclosure.

The visual image is formed by, for example, developing the latent electrostatic image by the development device with the development agent described above of the present disclosure.

Any known development device that can perform development with the development agent of the present disclosure is suitably selected. For example, a development device that accommodates the development agent of the present disclosure and includes a development unit which attaches the development agent to the latent electrostatic image in a contact or non-contact manner can be suitably used. A development device having the development agent container is more preferable.

The development device is of a single color development type or a multi-color development type. The development device suitably includes, for example, a stirrer that triboelectrically charges the toner and a rotary magnet roller.

In the development device, the toner and a carrier are mixed and stirred to triboelectrically charge the toner. The toner is then held on the surface of the rotating magnet roller in a filament manner to form a magnet brush. Since the magnet roller is provided in the vicinity of the image bearing member, part of the toner forming the magnet brush borne on the surface of the magnet roller is transferred to the surface of the image bearing member by the force of the electric attraction. As a result, the latent electrostatic image is developed with the toner and visualized as a toner image on the surface of the image bearing member.

The development agent contained in the development device is the development agent of the present disclosure.

Transfer Process and Transfer Device

The transfer process mentioned above is a process in which the visual image mentioned above is transferred to a recording medium. It is preferred that the visual image is primarily transferred to an intermediate transfer body and thereafter secondarily transferred to the recording medium. Further, it is more preferred use a two-color toner, preferably a full color toner in the processes in which the visual image is primarily transferred to an intermediate transfer body to form a complex transfer image and the complex transfer image is thereafter secondarily transferred to the recording medium.

The transfer process can be performed by, for example, charging the latent electrostatic image bearing member (photoreceptor) with a transfer charging device and by the transfer device. The transfer device preferably has a primary transfer device to form a complex transfer image by transferring a visual image to an intermediate transfer body and a secondary transfer device to transfer the complex transfer image to a recording medium.

There is no specific limit to the intermediate transfer body and any known transfer body can be suitably selected. For example, a transfer belt is preferably used.

The transfer device (the primary transfer device, the secondary transfer device) preferably has a transfer unit which peeling-charges the visual image formed on the image bearing member (photoreceptor) to the side of the recording medium. One or more transfer units may be used.

Specific examples of the transfer units include, but are not limited to, a corona transfer unit using corona discharging, a transfer belt, a transfer roller, a pressure transfer roller, and an adhesive transfer unit.

There is no specific limit to the recording medium and any known recording medium (recording paper) can be suitably used.

Fixing Process and Fixing Device

The fixing process is a process in which a visual image transferred to a recording medium is fixed by the fixing device and can be performed every time color development agent is transferred to the recording medium or at one time after color development agent is accumulated.

There is no specific limit to the fixing device and any known pressing and heating device can be suitably selected. Such a known pressing and heating device is formed of, for example, a combination of a heating roller and a pressure roller or a combination of a heating roller, a pressure roller and an endless belt.

The fixing device preferably has a heating body having a heat generator, a film in contact with the heating body, and a pressing member that presses the heating body via the film to fix an unfixed image on a recording medium while the recording medium passes between the film and the pressing member. Heating by the pressing and heating device is preferably from 80 to 200° C.

In the fixing process and the fixing device for use in the present disclosure, for example, any known optical fixing device and the fixing process can be used together with or in place of the fixing device and the fixing process described above.

The discharging process is a process in which a discharging bias is applied to the image bearing member to discharge the image bearing member and is suitably performed by a discharging device.

There is no specific limit to the discharging device and any known discharging device as long as it can apply a discharging bias to the image bearing member. For example, a discharging lamp, can be suitably used.

The cleaning process is a process in which the toner remaining on the image bearing member is removed and can be performed by the cleaning device.

There is no specific limit to the selection of the cleaning device and any known cleaner can be selected as long as it can remove the toner remaining on the image bearing member. Preferred specific examples of such cleaners include, but are not limited to, a magnetic brush cleaner, a magnetic roller cleaner, a blade cleaner, a brush cleaner, and a web cleaner.

The recycle process is a process in which the toner removed in the cleaning process is returned to the development device and suitably performed by a recycling device. There is no specific limit to the recycling device and any known transfer device can be used.

The control process is a process in which each process described above is controlled and suitably performed by a control device.

There is no specific limit to the control device and any known control device is suitably selected as long as it controls each device. Devices such as a sequencer or a computer can be used the control device.

FIG. 1 is a diagram illustrating an example of the image forming apparatus for use in the present disclosure. An image forming apparatus 100A includes a photoreceptor drum 100, a charging roller 20, an irradiator (not shown), a development device 40, an intermediate transfer belt 50, a cleaning device 60 having a cleaning blade, a discharging lamp 70.

The intermediate transfer belt 50 is a seamless belt suspended by three rollers 51 provided inside the intermediate transfer belt 50 and is rotatable in the direction indicated by an arrow. Part of the three rollers 51 serve as transfer bias rollers that can apply a transfer bias (primary transfer bias) to the intermediate transfer belt 50. In addition, around the intermediate transfer belt 50 is provided a cleaning device 90 having a cleaning blade. Furthermore, a transfer roller 80 that can apply a transfer bias (secondary transfer bias) to transfer a toner image to a transfer sheet 95 is provided opposing the intermediate transfer belt 50. In addition, around the intermediate transfer belt 50, a corona charger 58 to impart charges to the toner image transferred to the intermediate transfer belt 50 is provided between the contact portion of the photoreceptor drum 10 and the intermediate transfer belt 50 and the contact portion of the intermediate transfer belt 50 and the transfer sheet 95 relative to the rotation direction of the intermediate transfer belt 50.

The development device 40 includes a development belt 41 and a black development unit 45*k*, a yellow development unit 45Y, a magenta development unit 45M, and a cyan development unit 45C provided around the development belt 41. The development unit 45 for each color includes a development agent container 42, a development agent supply roller 43, and a development roller 44. Moreover, the development belt 41 is a seamless belt suspended by multiple belt rollers and is rotatable in the direction indicated by an arrow. Furthermore, part of the development belt 41 is in contact with the photoreceptor drum 10.

Next, a method of forming an image using the image forming apparatus 100A is described. After uniformly charging the surface of the photoreceptor drum 100 using the charging roller 20, a latent electrostatic image is formed by irradiating the photoreceptor drum 10 with an irradiation light L using the irradiator (not shown). Next, a latent electrostatic image formed on the photoreceptor drum 10 is developed with toner supplied from the development device 40 to form a toner image. Furthermore, a transfer roller 10 that can apply a transfer bias (secondary transfer bias) to transfer a toner image to a transfer sheet 51 is provided opposing the intermediate transfer belt 50. The surface of the photoreceptor 10 from which the toner image is transferred to the intermediate transfer belt 50 is cleared of the toner remaining on the surface by the cleaning device 60 and discharged by the discharging lamp 70.

Figure 2:
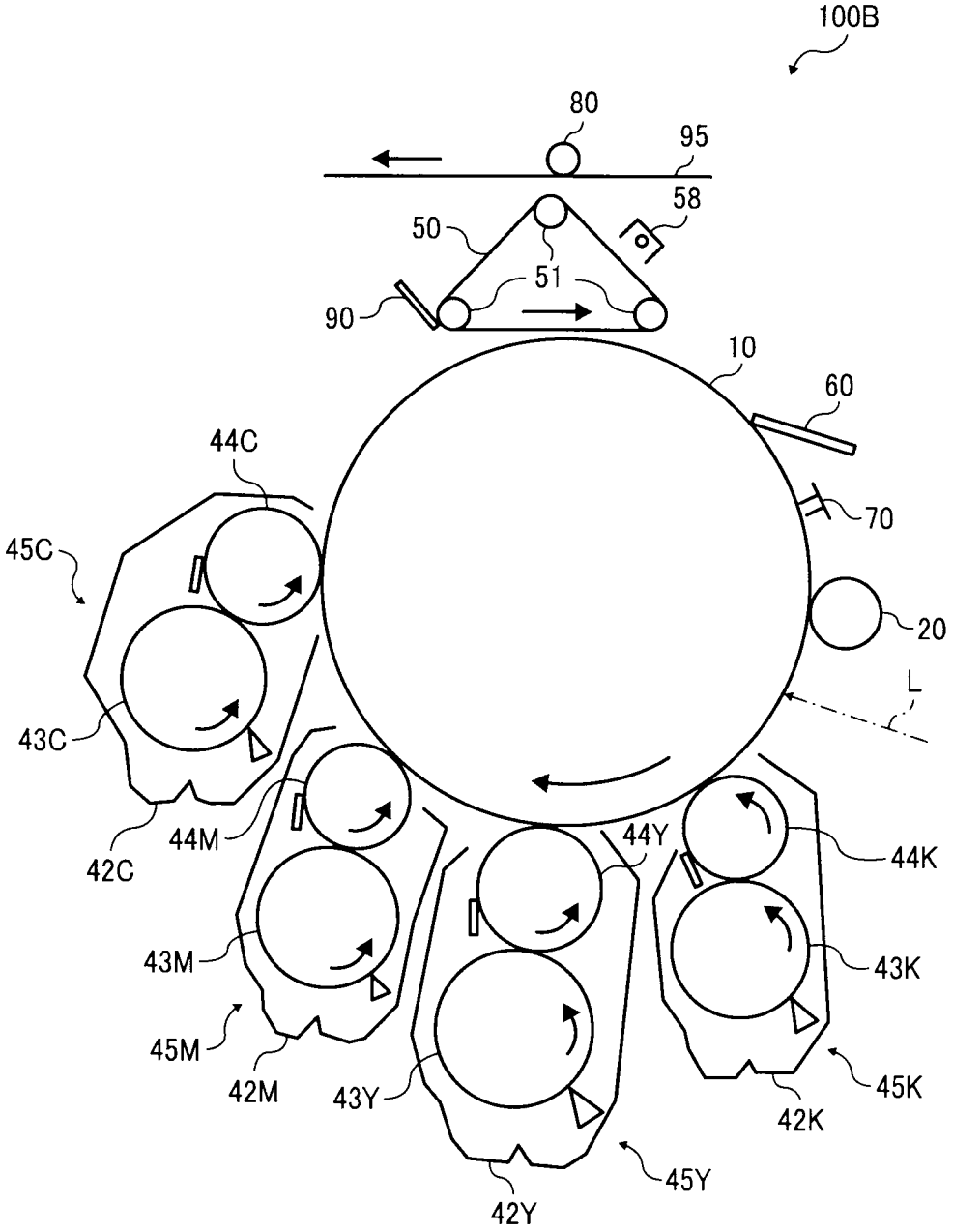
FIG. 2 is a schematic diagram illustrating another example of the image forming method of the present disclosure executed by an image forming apparatus.

FIG. 2 is a diagram illustrating a second example of the image forming apparatus for use in the present disclosure. The image forming apparatus 100B includes has the same structure as the image forming apparatus 100A except that no development device 41 is provided and the black development unit 45K, the yellow development unit 45Y, the magenta development unit 45M, and the cyan development unit 45C are provided directly opposing the photoreceptor drum 100.

Figure 3:
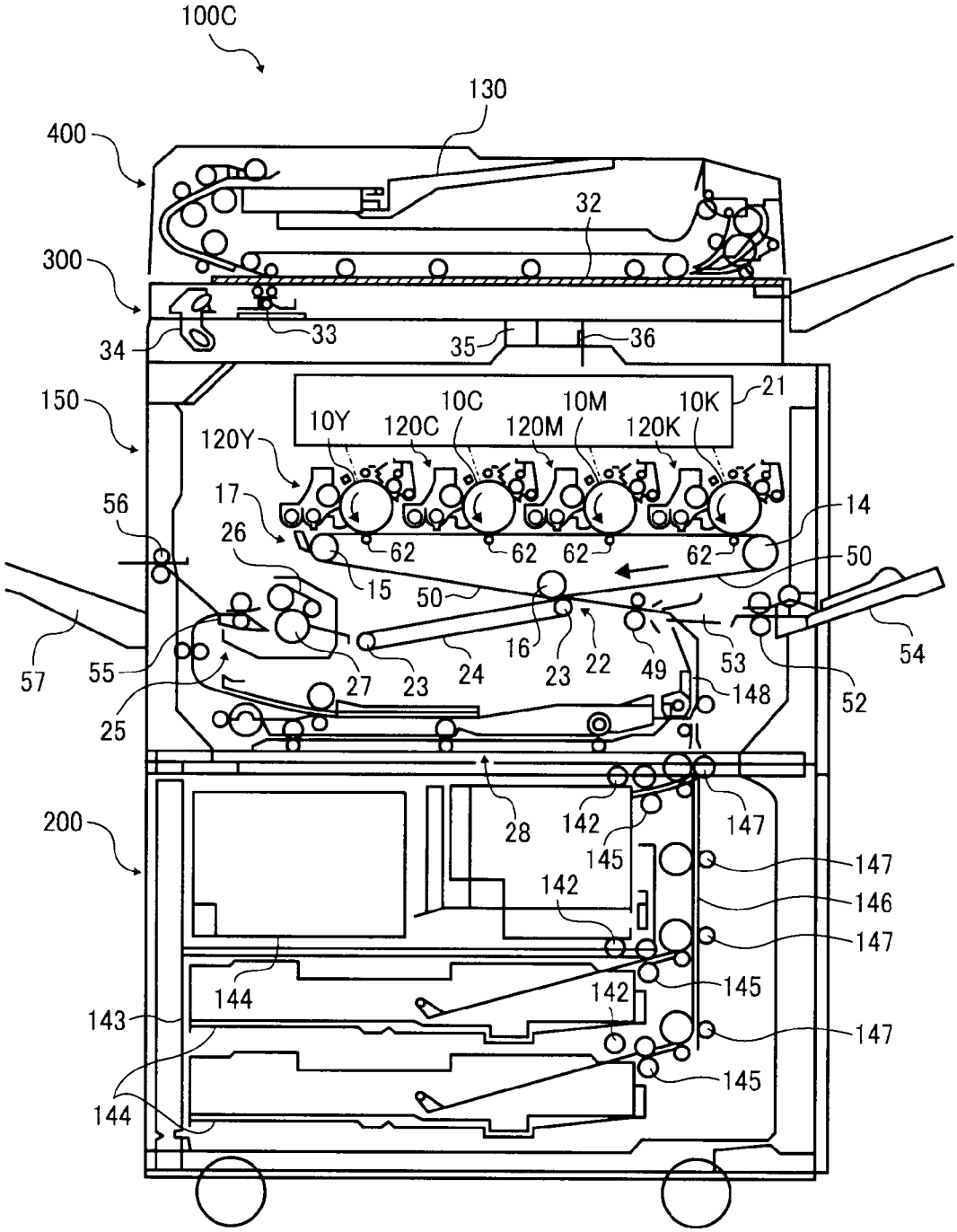
FIG. 3 is a schematic diagram illustrating an example of the image forming method of the present disclosure executed by a tandem type image forming apparatus.

FIG. 3 is a diagram illustrating a third example of the image forming apparatus for use in the present disclosure. An image forming apparatus 100C is a tandem type color image forming apparatus and includes a photocopying unit 150, a paper feeder table 200, a scanner 300, and a automatic document feeder (ADF) 400.

The intermediate transfer belt 50 provided in the center of the housing of the photocopying unit 150 is a seamless belt suspended over three rollers 14, 15, and 16 and rotatable in the direction indicated by an arrow. Around the roller 15 is provided a cleaning device 17 having a cleaning blade to remove the toner remaining on the intermediate transfer belt 50 from which the toner image is transferred.

An image forming unit 120 including an image forming unit 120Y, 120C, 120M, and 120K for yellow, magenta, cyan and black, respectively, are arranged in serial along the transfer direction of the transfer sheet while opposing the intermediate transfer belt 50 suspended by the rollers 14 and 15. In addition, an irradiator 21 is provided around the image forming unit 120. Furthermore, a secondary transfer belt 24 contained in a secondary transfer device 22 is provided opposing the intermediate transfer belt 50 on the reverse side relative to the image forming unit 120. The secondary transfer belt 24 is a seamless belt suspended over a pair of rollers 23 and the recording medium (transfer sheet) transferred on the secondary transfer belt 24 and the intermediate transfer belt 50 contact with each other between the roller 16 and a roller 23. In addition, a fixing belt 26 of a seamless belt suspended over a pair of rollers and a fixing device 25 having a pressing roller 27 pressed against the fixing belt 26 are provided around the secondary transfer belt 24. In addition, a sheet reversing device 28 to reverse the recording medium is provided around the secondary transfer belt 24 and the fixing device 25 to form images on both sides of the recording medium.

Next, a method of forming a full color image by using the image forming apparatus 100C is described. First, a color original is set on a document table 130 of the automatic document feeder (ADF) 400, or after the automatic document feeder 400 is opened, a color document is set on a contact glass 32 of the scanner 300 and then the automatic document feeder 400 is closed. When a start switch (not shown) is pressed, the scanner 300 starts driving after the original is transferred onto the contact glass 32 when the original is set on the automatic document handler 400 or immediately when the original is set on the contact glass 32 and a first travelling body 33 having a light source and a second travelling body 34 having a mirror travel. The irradiation light from the first travelling body 33 is reflected at the original and the reflected light is reflected at the second travelling body 34. Thereafter, the reflected light is received at a reading sensor 36 via an image focusing lens 35 to read the original and thus color image information of black, yellow, magenta, and cyan of the originals obtained.

Figure 4:
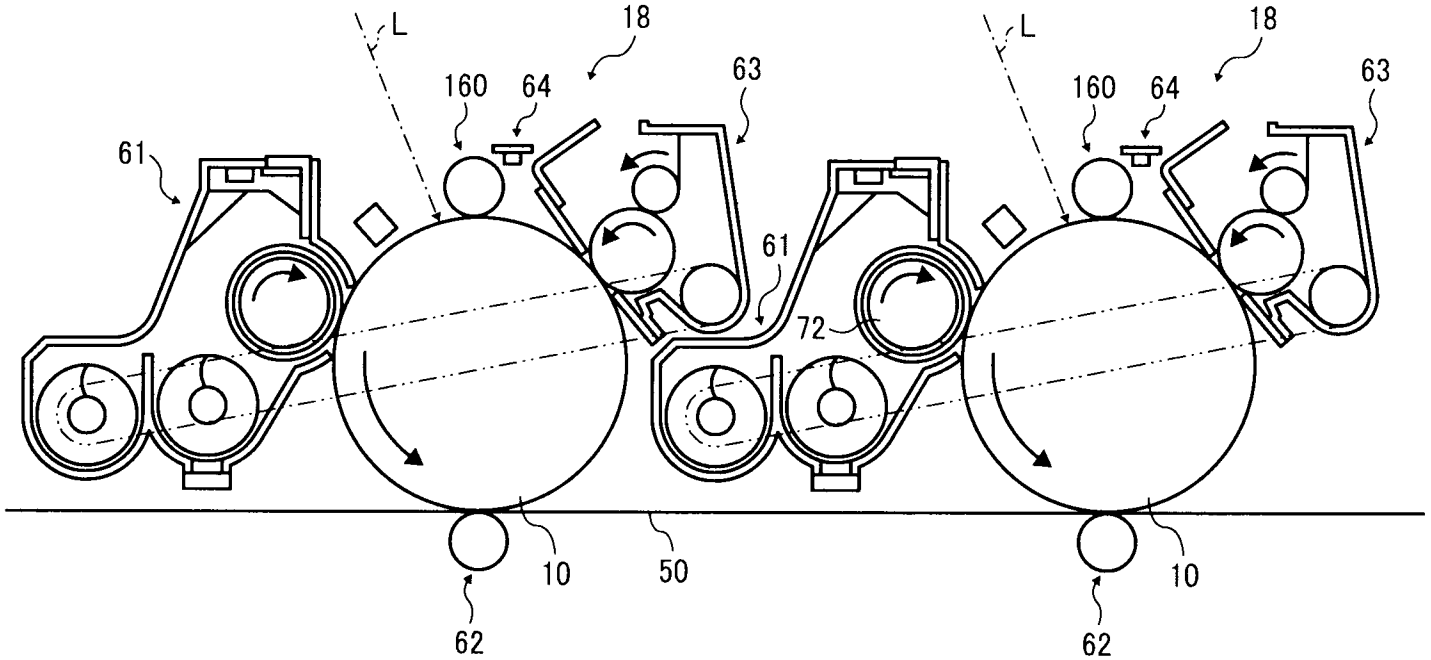
FIG. 4 is an enlarged schematic diagram illustrating part of the image forming apparatus illustrated in FIG. 3.

Each color image information is transferred to each color image forming unit 120 to form each color toner image. As illustrated in FIG. 4, each color image forming unit 120 includes the photoreceptor drum 10, a charging roller 160 that uniformly charges the photoreceptor drum 10, an irradiator that forms a latent electrostatic image for each color by irradiating the photoreceptor drum 10 with the irradiation light L based on image information for each color, a development device 61 that forms each color toner image by developing a latent electrostatic image with each corresponding color development agent, a transfer roller 62 that transfers the toner image to the intermediate transfer belt 50, a cleaning device 63 having a cleaning blade, and a discharging lamp 64.

Each color toner image formed by each image forming unit 120 is sequentially transferred (primarily transferred) to the intermediate transfer belt 50 which is moving suspended over the rollers 14, 15, and 16 to form an overlapped complex toner image (full color toner image).

With regard to the paper feeder table 200, one of paper feeder rollers 142 is selectively rotated to feed a recording medium from one of paper feeder cassettes 144 stacked in a paper bank. The recording medium is separated one by one by a separation roller 145, transferred to a paper path 146, guided to a paper path 148 in the photocopying unit 150 by a transfer roller 147, and held at a registration roller 49. Alternatively, the recording medium on a manual feeder tray 54 is fed by rotating a paper feeder roller and separated one by one by a separation roller 52. The recording medium is guided into a manual feeding path 53, and held at the registration roller 49. The registration roller 49 is generally used grounded but can be biased to remove paper dust of the recording medium. Next, by rotating the registration roller 49 in synchronization with the complex toner image formed on the intermediate transfer belt 50, the recording medium is sent out between the intermediate transfer belt 50 and the secondary transfer belt 24 to (secondarily) transfer the complex toner image to the recording medium. The toner remaining on the intermediate transfer belt 50 from which the complex toner image has been transferred is removed by the cleaning device 17.

The recording medium to which the complex toner image is transferred is transferred by the transfer belt 24 and then fixed by the fixing device 25. Next, a switching claw 55 switches the paper path of the recording medium and the recording medium is discharged by a discharging roller 56. Alternatively, the transfer path of the recording medium is switched by the switching claw 55 and the recording medium is reversed by the sheet reversing device 28. After an image is formed on the reverse side of the recording medium, the recording medium is discharged to a discharging tray 57 by the discharging roller 56.

In the image forming method of the present disclosure, quality images can be stably produced with the toner of the present disclosure for an extended period of time for environmental change with regard to temperature, moisture, etc.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLE

Manufacturing Example 1

Manufacturing of Prepolymer a-1

| | |
|---|---|
| 1.3-propane diol | 2 parts |
| L-lactide | 72 parts |
| D-lactide | 28 parts |
| Stannous octanoate | 0.06 parts |

The recipe specified above is placed in an autoclave reaction container equipped with a thermometer, a stirrer, and a nitrogen introducing tube to conduct ring-opening polymerization in a nitrogen stream at 160° C. for eight hours. Thereafter, the remaining lactide is removed under a reduced pressure to obtain an intermediate polyester resin 1 containing a polyhydroxycarboxylic acid skeleton. The intermediate polyester resin 1 has a number average molecular weight of 4,300, a weight average molecular weight of 16,000 and an optical purity of 44%.

| | |
|---|---|
| Intermediate polyester resin 1 | 400 parts |
| Isophorone diisocyanate | 95 parts |
| Ethyl acetate | 580 parts |

Next, the recipe specified above is placed in a reaction container equipped with a condenser, a stirrer, and a nitrogen introducing tube to conduct reaction at 100° C. for eight hours to synthesize Prepolymer a-1

Manufacturing Example 2

Manufacturing of Prepolymer a-2

| | |
|---|---|
| 1,3-propane diol | 2.7 parts |
| Glycerine | 0.36 parts |
| L-lactide | 75 parts |
| LD-meso lactide | 72 parts |
| Stannous octanoate | 0.09 parts |

The recipe specified above is placed in an autoclave reaction container equipped with a thermometer, a stirrer, and a nitrogen introducing tube to conduct ring-opening polymerization in a nitrogen stream at 160° C. for eight hours. Thereafter, the remaining lactide is removed under a reduced pressure to obtain an intermediate polyester resin 2 containing a polyhydroxycarboxylic acid skeleton. The intermediate polyester resin 2 has a number average molecular weight of 3,900, a weight average molecular weight of 13,500 and an optical purity of 51%.

| | |
|---|---|
| Intermediate polyester resin 2 | 400 parts |
| Isophorone diisocyanate | 95 parts |
| Ethyl acetate | 580 parts |

Next, the recipe specified above is placed in a reaction container equipped with a condenser, a stirrer, and a nitrogen introducing tube to conduct reaction at 100° C. for eight hours to synthesize Prepolymer a-2.

Manufacturing Example 3

Manufacturing of Prepolymer a-3

| | |
|---|---|
| 1.3-propane diol | 1.4 parts |
| Glycerine | 0.73 parts |
| L-lactide | 50 parts |
| LD-methlactide | 48 parts |
| Stannous octanoate | 0.06 parts |

The recipe specified above is placed in an autoclave reaction container equipped with a thermometer, a stirrer, and a nitrogen introducing tube to conduct ring-opening polymerization in a nitrogen stream at 160° C. for eight hours. Thereafter, the remaining lactide is removed under a reduced pressure to obtain an intermediate polyester resin 3 containing a polyhydroxycarboxylic acid skeleton. The intermediate polyester resin 3 has a number average molecular weight of 5,500, a weight average molecular weight of 18,700 and an optical purity of 51%.

| | |
|---|---|
| Intermediate polyester resin 3 | 400 parts |
| Isophorone diisocyanate | 95 parts |
| Ethyl acetate | 580 parts |

Next, the recipe specified above is placed in a reaction container equipped with a condenser, a stirrer, and a nitrogen introducing tube to conduct reaction at 100° C. for eight hours to synthesize Prepolymer a-3

Manufacturing Example 4

Manufacturing of Prepolymer a-4

| | |
|---|---|
| Glycerine | 3.1 parts |
| L-lactide | 70 parts |
| LD-methlactide | 60 parts |
| Stannous octanoate | 0.05 parts |

The recipe specified above is placed in an autoclave reaction container equipped with a thermometer, a stirrer, and a nitrogen introducing tube to conduct ring-opening polymerization in a nitrogen stream at 160° C. for eight hours. Thereafter, the remaining lactide is removed under a reduced pressure to obtain an intermediate polyester resin 4 containing a polyhydroxycarboxylic acid skeleton. The intermediate polyester resin 4 has a number average molecular weight of 3,400, a weight average molecular weight of 14,900 and an optical purity of 54%.

| | |
|---|---|
| Intermediate polyester resin 4 | 400 parts |
| Ethylene glycol diglycidyl ether | 95 parts |
| Ethyl acetate | 580 parts |

Next, the recipe specified above is placed in a reaction container equipped with a condenser, a stirrer, and a nitrogen introducing tube to conduct reaction at 90° C. for eight hours to synthesize Prepolymer a-4.

Manufacturing Example 5

Manufacturing of Prepolymer a-5

| | |
|---|---|
| Adduct of bisphenol A with 2 mols of ethylene oxide | 720 parts |
| Adduct of bisphenol A with 2 mols of propylene oxide | 90 parts |
| Terephtahlic acid | 290 parts |
| Trimellitic anhydride | 25 parts |
| Dibutyl tin oxide | 2 parts |

Next, the recipe specified above is placed in a reaction container equipped with a condenser, a stirrer, and a nitrogen introducing tube to conduct reaction at 230° C. for eight hours in a normal pressure followed by reaction under a reduced pressure of 10 to 15 mmHg for seven hours to synthesize Intermediate polyester resin 5. The intermediate polyester resin 5 has a number average molecular weight Mn of 2,500, a weight average molecular weight of 10,700, a peak molecular weight of 3,400, a glass transition temperature Tg of 57° C., an acid value of 0.4 mgKOH/g, and a hydroxyl value of 49 mgKOH/g.

| | |
|---|---|
| Intermediate polyester resin 5 | 400 parts |
| Isophorone diisocyanate | 95 parts |
| Ethyl acetate | 580 parts |

Next, the recipe specified above is placed in a reaction container equipped with a condenser, a stirrer, and a nitrogen introducing tube to conduct reaction at 100° C. for eight hours to synthesize Prepolymer a-5. The obtained Prepolymer a-5 contains an isolated isocyanate in an amount of 1.42% by weight.

Manufacturing Example 6

Manufacturing of Second Binder Resin b-1

| | |
|---|---|
| L-lactide | 70 parts |
| D-lactide | 30 parts |
| ϵ-caprolactone | 5 parts |
| Stannous octanoate | 0.03 parts |

The recipe specified above is placed in an autoclave reaction container equipped with a thermometer, a stirrer, and a nitrogen introducing tube to conduct ring-opening polymerization in a nitrogen stream at 190° C. for one hour. Thereafter, the remaining lactide is removed under a reduced pressure to obtain a Second binder resin b-1 containing a polyhydroxycarboxylic acid skeleton. The Second binder resin b-1 has a number average molecular weight of 9,200, a weight average molecular weight of 37,900 and an optical purity of 40%.

Manufacturing Example 7

Manufacturing of Second Binder Resin b-2

| | |
|---|---|
| L-lactide | 70 parts |
| LD-methlactide | 60 parts |
| Stannous octanoate | 0.05 parts |

The recipe specified above is placed in an autoclave reaction container equipped with a thermometer, a stirrer, and a nitrogen introducing tube to conduct ring-opening polymerization in a nitrogen stream at 180° C. for two hours. Thereafter, the remaining lactide is removed under a reduced pressure to obtain a Second binder resin b-2 containing a polyhydroxycarboxylic acid skeleton.

The Second binder resin b-2 has a number average molecular weight of 7,500, a weight average molecular weight of 29,000 and an optical purity of 54%.

Manufacturing Example 8

Manufacturing of Second Binder Resin b-3

| | |
|---|---|
| 1.3-propane diol | 2 parts |
| L-lactide | 50 parts |
| LD-methlactide | 48 parts |
| Stannous octanoate | 0.06 parts |

The recipe specified above is placed in an autoclave reaction container equipped with a thermometer, a stirrer, and a nitrogen introducing tube to conduct ring-opening polymerization in a nitrogen stream at 160° C. for 15 hours. Thereafter, the remaining lactide is removed under a reduced pressure to obtain a Second binder resin b-3 containing a polyhydroxycarboxylic acid skeleton. The Second binder resin b-3 has a number average molecular weight of 8,200, a weight average molecular weight of 34,000 and an optical purity of 51%.

Manufacturing Example 9

Manufacturing of Second Binder Resin b-4

| | |
|---|---|
| L-lactide | 85 parts |
| LD-methlactide | 25 parts |
| Stannous octanoate | 0.04 parts |

The recipe specified above is placed in an autoclave reaction container equipped with a thermometer, a stirrer, and a nitrogen introducing tube to conduct ring-opening polymerization in a nitrogen stream at 180° C. for two hours. Thereafter, the remaining lactide is removed under a reduced pressure to obtain a Second binder resin b-4 containing a polyhydroxycarboxylic acid skeleton.

The Second binder resin b-4 has a number average molecular weight of 8,800, a weight average molecular weight of 36,000 and an optical purity of 77%.

Manufacturing Example 10

Manufacturing of Second Binder Resin b-5

| | |
|---|---|
| Adduct of bisphenol A with 2 mols of EO | 10 parts |
| Terephtahlic acid | 8 parts |
| Adipic acid | 2 parts |
| Stannous octanoate | 0.006 parts |

A toluene solution containing the recipe specified above is placed in an autoclave reaction container equipped with a thermometer, a stirrer, and a nitrogen introducing tube to conduct ring-opening polymerization in a nitrogen stream at 200° C. for 15 hours under 8 kPa to obtain a Second binder resin b-5.

Manufacturing Example 11

Manufacturing of Aqueous Dispersion of Resin Particulate c-1 Formed of Third Binder Resin A mixture of 56 parts of terephthalic acid, 27 parts of isophthalic acid, 12 parts of ethylene glycol, and 31 parts of neopentyl glycol is place in an autoclave reaction container to conduct esterification reaction at 260° C. for four hours. Then, 0.05 parts of tetrabutyl titanate is added as a catalyst followed by heating the system to 280° C. and the system is gradually reduced in pressure. The pressure is 13 Pa after 1.5 hours. Under this condition, the polycondensation reaction is continued and the pressure of the system is back to normal in two hours with nitrogen gas and the temperature of the system is lowered. When the temperature is down to 270° C., 22 parts of trimellitic acid is added to conduct depolymerization reaction at 250° C. while stirring for one hour.

Thereafter, nitrogen gas is introduced to increase the pressure of the system to extrude a resin having a sheet form. After cooling down to the room temperature, the resin is pulverized by a crusher and screened by a sieve having an opening of from 1 to 6 mm to obtain particle fractions of a Third binder resin C-1.

100 parts of Third binder resin C-1, 60 parts of isopropyl alcohol, 1.6 parts of 28% weight % ammonium water, and 170 parts of distillated water are placed in a stirrer having a glass vessel with a jacket (T.K. Robomix, manufactured by Primix Corporation) for stirring at 7,000 rpm.

Stirring continues for 60 minutes while the system is heated by passing heated water through the jacket to maintain the temperature of the system in the range of from 73° C. to 75° C. Thereafter, stirring still continues while flowing cold water in the jacket and reducing the rotation speed to 5,000 rpm to cool down the system to room temperature, uniform cream white aqueous liquid dispersion of Third binder resin C-1.

300 parts of the aqueous liquid dispersion of Third binder resin C-1 and 80 parts of distillated water are placed in a flask having to mouths. A mechanical stirrer and a Liebig condenser are arranged and the flask is heated by oil bath to distil the aqueous medium away. Heating is finished when about 160 parts of the aqueous medium is distilled away and the system is cooled down to room temperature.

Subsequent to cooling down, the liquid composition in the flask is screened by a filter having 600 meshes (twilled weave dutch). The concentration of the solid portion of the filtrate is 40% by weight. Distillated water is added to the filtrate while stirring and the concentration of the solid portion is adjusted to be 30% by weight to obtain an aqueous liquid dispersion of Resin particulate c-1. The particulates contained in the aqueous liquid dispersion of Resin particulate c-1 has a volume average particle diameter of 107 nm. The resin portion has a weight average molecular weight of is 13,500, a glass transition temperature of 63 C, and an acid value of 22.3 mgKOH/g.

Manufacturing Example 12

Manufacturing of Aqueous Dispersion of Resin Particulate c-2 Formed of Third Binder Resin 1.6 parts of dodecyl sodium sulfate, 486 parts of deionized water are placed in a reaction contained equipped with a condenser, a stirrer, and a nitrogen introducing tube, heated to 80° C. with stirring, and dissolved. Thereafter, a solution in which 2.8 parts of potassium persulfate are dissolved in 109 parts of deionized water is added to this reaction container. After 15 minutes, a liquid mixture of 180 parts of styrene and 20 parts of butyl acrylate are dropped to the reaction container in 90 minutes.

Thereafter, the system is maintained at 80° C. for 60 minutes to conduct polymerization reaction. Subsequent to cooling down, Aqueous dispersion of resin particulate c-2 is obtained. The particulates contained in the aqueous liquid dispersion of Resin particulate c-2 have a volume average particle diameter of 78 nm. The resin portion has a weight average molecular weight of is 220,000 and a glass transition temperature of 85° C.

Examples 1 to 10 and Comparative Example 1 to 3

Manufacturing of Toner

Preparation of Aqueous Phases 1 to 13

990 parts of water, 37 parts of 48.5% by weight aqueous solution of dodecyl diphenyl ether sodium disulfate (Eleminol Mon-7, manufactured by Sanyo Chemical Industries, Ltd.), 90 parts of ethyl acetate, and 83 parts of Aqueous dispersion of resin particulates manufactured in Manufacturing Examples 11 and 12 selected as shown in Table 1 are mixed and stirred to obtain Aqueous Phases 1 to 13.

TABLE 1

| Aqueous Phase | |
|---|---|
| | Third binder resin |
| Aqueous phase 1 | C-1 |
| Aqueous phase 2 | — |
| Aqueous phase 3 | C-1 |
| Aqueous phase 4 | — |
| Aqueous phase 5 | C-1 |
| Aqueous phase 6 | — |
| Aqueous phase 7 | C-2 |
| Aqueous phase 8 | — |
| Aqueous phase 9 | C-2 |
| Aqueous phase 10 | — |
| Aqueous phase 11 | C-2 |
| Aqueous phase 12 | C-1 |
| Aqueous phase 13 | C-1 |

Manufacturing of Master Batch 1

| | |
|---|---|
| Manufacturing of Second Binder Resin b-1 | 100 parts |
| Carbon Black (Printex 35, manufactured by Degusa AG) (DBP oil absorption: 42 ml/100 g, pH: 9.5) | 100 parts |
| Water | 50 parts |

The recipe specified above is mixed using a Henschel Mixer (manufactured by NIPPON COKE & ENGINEER- ING. CO., LTD.) The obtained mixture is mixed and kneaded at 80° C. for 30 minutes by using a two-roll and thereafter rolled and cooled down followed by pulverization by a pulverizer (manufactured by Hosokawa Micron Group) to manufacture Master Batch 1.

Manufacturing of Master Batch 2

| | |
|---|---|
| Manufacturing of Second Binder Resin b-5 | 100 parts |
| Carbon Black (Printex 35, manufactured by Degusa AG) (DBP oil absorption: 42 ml/100 g, pH: 9.5) | 100 parts |
| Water | 50 parts |

The recipe specified above is mixed using a Henschel Mixer (manufactured by NIPPON COKE & ENGINEERING. CO., LTD.) The obtained mixture is mixed and kneaded at 80° C. for 30 minutes by using a two-roll and thereafter rolled and cooled down followed by pulverization by a pulverizer (manufactured by Hosokawa Micron Group) to manufacture Master Batch 2.

Preparation of Wax Liquid Dispersion 1

| | |
|---|---|
| Manufacturing of Second Binder Resin b-1 | 300 parts |
| Carnauba wax | 90 parts |
| Molecular weight: 1,800, Acid value: 2.7 mgKOH/g, Penetration degree 1.7 mm (40° C.) | |
| Ethyl acetate | 1,000 parts |

The recipe specified above is prepared and dissolved at 79° C. while stirring followed by cooling-down to 4° C. at once. Using a Bead mill (Ultra Visco Mill, manufactured by IMEX Co., Ltd.), Wax liquid dispersion 1 having a volume average particle diameter of 0.6 μm is prepared by filling zirconia beads of 0.5 mm with a liquid sending speed of 1 kg/hour and a disc circumference speed of 6 m/s to 80% by volume with 3 passes.

Preparation of Wax Liquid Dispersion 2

| | |
|---|---|
| Manufacturing of Second Binder Resin b-5 | 300 parts |
| Carnauba wax | 90 parts |
| Molecular weight: 1,800, Acid value: 2.7 mgKOH/g, Penetration degree 1.7 mm (40° C.) | |
| Ethyl acetate | 1,000 parts |

The recipe specified above is prepared and dissolved at 79° C. while stirring followed by cooling-down to 4° C. at once.

The resultant is subjected to dispersion under the conditions of filling zirconia beads of 0.5 mm to 80% by volume with a liquid sending speed of 1 kg/hour and a disc circumference speed of 6 m/s with 3 passes by using a Bead mill (Ultra Visco Mill, manufactured by IMEX Co., Ltd.) to obtain Wax liquid dispersion 2 having a volume average particle diameter of 0.6 μm.

Preparation of Oil Phases 1 to 13

Next, the material shown in Table 2 is subjected to three passes by of a Bead mill (Ultra Visco Mill, manufactured by IMEX Co., Ltd.) under the conditions of filling zirconia beads of 0.5 mm to 80% by volume with a liquid sending speed of 1 kg/hour and a disc circumference speed of 6 m/s to obtain Oil phases 1 to 13.

TABLE 2

| | Oil Phase | | | | | | |
|---|---|---|---|---|---|---|---|
| | Second binder resin | | Wax liquid dispersion | | Master batch | | Ethyl acetate |
| Oil phase 1 | b-1 | 160 parts | (1) | 120 parts | (1) | 12 parts | 80 parts |
| Oil phase 2 | b-1 | 160 parts | (1) | 120 parts | (1) | 12 parts | 80 parts |
| Oil phase 3 | b-2 | 160 parts | (1) | 120 parts | (1) | 12 parts | 80 parts |
| Oil phase 4 | b-2 | 160 parts | (1) | 120 parts | (1) | 12 parts | 80 parts |
| Oil phase 5 | b-3 | 160 parts | (1) | 120 parts | (1) | 12 parts | 80 parts |
| Oil phase 6 | b-3 | 160 parts | (1) | 120 parts | (1) | 12 parts | 80 parts |
| Oil phase 7 | b-4 | 160 parts | (1) | 120 parts | (1) | 12 parts | 80 parts |
| Oil phase 8 | b-4 | 160 parts | (1) | 120 parts | (1) | 12 parts | 80 parts |
| Oil phase 9 | b-5 | 160 parts | (2) | 120 parts | (2) | 12 parts | 80 parts |
| Oil phase 10 | b-5 | 160 parts | (2) | 120 parts | (2) | 12 parts | 80 parts |
| Oil phase 11 | b-5 | 160 parts | (2) | 120 parts | (2) | 12 parts | 80 parts |
| Oil phase 12 | b-4 | 160 parts | (1) | 120 parts | (1) | 12 parts | 80 parts |
| Oil phase 13 | b-1 | 160 parts | (1) | 120 parts | (1) | 12 parts | 80 parts |

Manufacturing of Mother Toners 1 to 13

Next, 90 parts of Oil phase 1, 8 parts of the Prepolymer a-1, and 1.4 parts of isophorone diamine are placed in a container and stirred at 5,000 rpm by a TK type Homomixer (manufactured by Primix Corporation) to obtain Oil Phase 1*. 150 parts of Aqueous phase 1 is placed in another container and Oil Phase 1* is added thereto while stirring with a TK type Homomixer at 12,000 rpm followed by 10-minute mixing to obtain an emulsified slurry. Furthermore, 100 parts of the emulsified slurry is placed in a flask equipped with a stirrer and a thermometer and the solvent is removed at 30° C. for 10 hours while stirring at a stirring circumference speed of 20 m/minute followed by washing, filtration, and drying. Thereafter, the resultant is screened by a mesh having an opening of 75 μm to manufacture a Mother Toner 1.

Mother Toners 2 to 13 are manufactured in the same manner as described above as shown in Table 3.

TABLE 3

| | Prepolymer | Oil phase | Aqueous phase |
|---|---|---|---|
| Mother toner (1) | a-1 | Oil phase 1 | Aqueous phase 1 |
| Mother toner (2) | a-2 | Oil phase 2 | Aqueous phase 2 |

TABLE 3-continued

| | Prepolymer | Oil phase | Aqueous phase |
|---|---|---|---|
| Mother toner (3) | a-1 | Oil phase 3 | Aqueous phase 3 |
| Mother toner (4) | a-2 | Oil phase 4 | Aqueous phase 4 |
| Mother toner (5) | a-1 | Oil phase 5 | Aqueous phase 5 |
| Mother toner (6) | a-2 | Oil phase 6 | Aqueous phase 6 |
| Mother toner (7) | a-3 | Oil phase 7 | Aqueous phase 7 |
| Mother toner (8) | a-4 | Oil phase 8 | Aqueous phase 8 |
| Mother toner (9) | a-3 | Oil phase 9 | Aqueous phase 9 |
| Mother toner (10) | a-4 | Oil phase 10 | Aqueous phase 10 |
| Mother toner (11) | a-5 | Oil phase 11 | Aqueous phase 11 |
| Mother toner (12) | a-5 | Oil phase 12 | Aqueous phase 12 |
| Mother toner (13) | — | Oil phase 13 | Aqueous phase 13 |

Manufacturing of Toners 1 to 13

100 parts of the thus obtained Mother Toners 1 to 13 and 1.0 parts of hydrophobic silica (H2000, manufactured by Clariant Japan K.K.) as an external additive are subjected to mixing at a circumference speed of 30 m/sec for 30 seconds by a Henschel Mixer (manufactured by NIPPON COKE & ENGINEERING. CO., LTD.) followed by one-minute recess five times. Subsequent to filtration of the resultant by a mesh having an opening of 35 μm, Toners 1 to 13 are obtained.

Manufacturing of Carrier

| | |
|---|---|
| Silicone resin (Organo straight silicone) | 100 parts |
| γ-(2-aminoethyl)aminopropyl trimethoxy silane | 5 parts |
| Carbon Black | 10 parts |
| Toluene | 100 parts |

The material specified above is dispersed by a Homomixer for 20 minutes to obtain a Liquid application for resin layer. Thereafter, the Liquid application for resin layer is applied to the surface of 1,000 parts of spherical ferrite having a volume average particle diameter of 35 μm by a fluidized bed type coating device to manufacture a carrier.

Manufacturing of Development Agent 5 parts of Toners 1 to 13 are mixed with 95 parts of the carrier to manufacture each development agent of Examples 1 to 10 and Comparative Examples 1 to 3.

The volume average particle diameter Dv and the number average particle diameter Dn and their ratio (Dv/Dn) of the thus obtained toner are measured and calculated as follows. The portion of the toner which is not soluble in tetrahydrofuran (THF) is also measured. The results are shown in Table 4.

Next, the fixing property, the high temperature preservability, the stability under environment change, and the image density are evaluated using the obtained development agents. The results are shown in Table 5.

Evaluation Method

Measuring Volume Average Particle Diameter Dv and Number Average

Particle Diameter Dn and Ratio (Dv/Dn)

The particle size distribution of the toner is measured by a Coulter Multisizer. A Coulter Multisizer III (manufactured by Beckman Coulter Inc.) is used as a measuring device to which an interface (manufactured by Nikkaki Bios Co., Ltd.) and a home computer are connected for outputting the number distribution and the volume distribution. About 1% NaCl aqueous solution is prepared by using primary NaCl as the electrolytic aqueous solution.

The measuring method is as followed: Add 0.1 to 5 ml of a surface active agent (preferably alkyl benzene sulfonate salt) as a dispersant to 100 to 150 ml of the electrolytic aqueous solution; Add 2 to 20 mg of a sample material thereto; Disperse the material for about 1 to 3 minutes by an ultrasonic dispersion device; Furthermore, add 100 to 200 ml of the electrolytic aqueous solution to another beaker; add the sample liquid dispersion to the electrolytic aqueous solution to become a predetermined density; Measure 50,000 particles using the Coulter Multisizer III with 100 μm aperture to obtain the average thereof; and obtain the ratio (Dv/Dn) from the obtained volume average particle diameter Dv and the obtained number average particle diameter Dn.

Fixing Property

By using an image forming apparatus having a remodeled fixing portion based on a photocopier (MF-200, manufactured by Ricoh Co., Ltd.) using a Teflon roller as the fixing roller, solid images with an toner attachment amount of from 0.75 to 0.95 mg/cm$^2$ are formed on plain paper, transfer paper type 6200 (manufactured by Ricoh Co., Ltd.), and photocopying printing paper <135> (manufactured by NBS Ricoh Co., Ltd.) while changing the temperature of the fixing belt. The temperature above which hot offset occurs on plain paper is determined as the upper limit of the fixing temperature.

In addition, the fixing temperature at which the remaining ratio of the image density of an image on a thick paper after the image is rubbed by a pad is 70% is the lower limit of the fixing temperature.

The thus obtained upper limit of the fixing temperature and the lower limit thereof are evaluated according to the following criteria.

Evaluation Criteria of Upper Limit of Fixing Temperature

- E (Excellent): the upper limit of the fixing temperature is 190° C. or higher
- G (Good): the lower limit of the fixing temperature is from 180° C. to lower than 190° C.
- F (Fair): the lower limit of the fixing temperature is from 170° C. to lower than 180° C.
- P (Poor): the upper limit of the fixing temperature is lower than 170° C.

Evaluation Criteria of Lower Limit of Fixing Temperature

- E (Excellent): the lower limit of the fixing temperature is lower than 110° C.
- G (Good): the lower limit of the fixing temperature is from 110° C. to lower than 120° C.
- F (Fair): the lower limit of the fixing temperature is from 120° C. to lower than 130° C.
- P (Poor): the lower limit of the fixing temperature is higher than 130° C.

Stability Under Environment Change

The obtained development agent is stirred in a ball mill for five minutes in an environment (MM environment) of 23° C. and RH of 50% and thereafter 1.0 g of the development agent is collected. After the development agent is blown with nitrogen for one minute using a blow-off charge amount measuring device (TB-200, manufactured by Kyosera Chemical Corporation) and the measured value is used as the amount of charge. In addition, the amount of charge of each development agent is evaluated in a condition (H/H environment) of 40° C. and RH of 90% and a condition (L/L environment) of 10° C. and RH of 30%. The environment change ratio is calculated from the following relation based on the thus obtained amounts of charge and the calculated environment change ratio is evaluated according to the following criteria. A stable development agent has a low environment change ratio.

$$\text{Environment variation}=2\times\{(L/L)-(H/H)\}/\{(L/L)+(H/H)\}\times 100(\%)$$

L/L represents the amount of charge in the L/L environment

H/H represents the amount of charge in the H/H environment

Evaluation Criteria

E (Excellent): the environment change ratio is less than 40%

G (Good): the environment change ratio is from 40% to less than 50%

F (Fair): the environment change ratio is from 50% to less than 60%

P (Poor): the environment change ratio is 60% or higher

Image Density

By using a tandem type color image forming apparatus (imagio Neo 450, manufactured by Ricoh Co., Ltd.), solid images with an toner attachment amount of from 0.95 to 1.05 mg/cm$^2$ are formed on photocopying paper TYPE 6000<70W> (manufactured by Ricoh Co., Ltd.) while setting the range of the surface temperature of the fixing roller between 158 C to 162 C. The image density of any 6 points of the obtained solid image is measured by spectrometer (938 Spectrodensitometer, manufactured by X-Rite, Inc.) to obtain the average of the image density. The obtained image density is evaluated according to the following criteria.

Evaluation Criteria

E (Excellent): Image density is 2.0 or higher

F (Fair): Image density is from 1.70 to less than 2.0

P (Poor): Image density is less than 1.70

Total Evaluation

The total evaluation is made about the toners according to those evaluation results.

Evaluation Criteria

E (Excellent): Extremely good (Three Es with no Ps)

G (Good): Good (One or two Es with no Ps)

P (Poor): Poor (No Es or Ps)

B (Bad): Extremely bad (One or more Ps)

TABLE 4

| | | Dv (μm) | Dn (μm) | Dv/Dn | THF insoluble portion |
|---|---|---|---|---|---|
| Example 1 | Toner 1 | 5.5 | 4.8 | 1.15 | Contained |
| Example 2 | Toner 2 | 5.3 | 4.6 | 1.15 | Contained |
| Example 3 | Toner 3 | 5.2 | 4.3 | 1.21 | Contained |
| Example 4 | Toner 4 | 5.2 | 4.4 | 1.18 | Contained |
| Example 5 | Toner 5 | 5.9 | 4.9 | 1.20 | Contained |
| Example 6 | Toner 6 | 5.3 | 4.7 | 1.13 | Contained |
| Example 7 | Toner 7 | 5.6 | 4.9 | 1.14 | Contained |
| Example 8 | Toner 8 | 5.1 | 4.6 | 1.11 | Contained |
| Example 9 | Toner 9 | 5.5. | 4.8 | 1.15 | Contained |
| Example 10 | Toner 10 | 5.8 | 4.7 | 1.23 | Contained |
| Comparative Example 1 | Toner 11 | 5.7 | 4.9 | 1.16 | Contained |
| Comparative Example 2 | Toner 12 | 5.4 | 4.7 | 1.15 | Contained |
| Comparative Example 3 | Toner 13 | 5.5 | 4.6 | 1.20 | Not contained |

TABLE 5

| | | Fixing Property | | Stability under | | |
|---|---|---|---|---|---|---|
| | | Lower limit temp. | Upper limit temp. | environ-ment change | Image density | Total eval-uation |
| Example 1 | Toner 1 | E | E | E | E | E |
| Example 2 | Toner 2 | E | E | G | E | G |
| Example 3 | Toner 3 | E | E | E | E | E |
| Example 4 | Toner 4 | E | E | G | E | G |
| Example 5 | Toner 5 | G | E | E | E | G |
| Example 6 | Toner 6 | E | E | G | E | G |
| Example 7 | Toner 7 | G | E | E | E | G |
| Example 8 | Toner 8 | E | G | G | E | G |
| Example 9 | Toner 9 | F | G | E | E | G |
| Example 10 | Toner 10 | F | G | E | E | G |
| Comparative Example 1 | Toner 11 | P | G | G | F | B |
| Comparative Example 2 | Toner 12 | F | F | F | F | P |
| Comparative Example 3 | Toner 13 | E | G | P | F | B |

As seen in Table 5, the development agents of Examples 1 to 10 have a better combination of the low temperature fixing property and the fixing range than the development agents of Comparative Examples 1 to 3 and have good results about the image density and the stability under environment change.

This document claims priority and contains subject matter related to Japanese Patent Application no. 2010-109997, filed on May 12, 2010, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin comprising a first binder resin A and a second binder resin B, wherein the second binder resin B is a non-crystalline polyester resin "b" having a polyhydroxy carboxylic acid skeleton in a main chain thereof, wherein the non-crystalline polyester resin "b" has a hydroxyl carboxylic acid skeleton formed of an optically active monomer, and the hydroxyl carboxylic acid skeleton has an optical purity X (%) of 80% or less, which is represented by the following relation:

$$\text{optical purity } X(\%)=|X(L\text{ form})-X(D\text{ form})|$$

where X (L form) represents an L form ratio (mol %) in optically active monomer conversion and X (D form) represents a D form ratio (mol %) in an optically active monomer conversion;

a coloring agent; and a releasing agent, wherein the first binder resin A is formed by reacting a compound A1 having an active hydrogen group with a resin A2 having a portion reactive with the compound A1 in an organic solvent; the resin A2 is formed by reacting a non-crystalline polyester resin "a" having a polyhydroxy carboxylic acid skeleton in a main chain with a compound having the portion reactive with the compound A1 having an active hydrogen group; and the non-crystalline polyester resin "a" is formed by copolymerizing a diol and a cyclic ester of a hydroxycarboxylic acid.

2. The toner according to claim 1, further comprising a portion insoluble in tetrahydrofuran (THF) deriving from the binder resin.

3. The toner according to claim 1, further comprising a structure in which a resin particulate "c" formed of a third binder resin C is attached to a surface of the toner.

4. The toner according to claim 1, wherein the non-crystalline polyester resin "a" is a straight chain polyester diol having a polyhydroxy carboxylic acid skeleton.

5. The toner according to claim 1, wherein the polyhydroxy carboxylic acid skeleton of the non-crystalline polyester resin "a" is obtained by ring-opening polymerization of a mixture of L-lactide and D-lactide.

6. The toner according to claim 1, wherein the polyhydroxy carboxylic acid skeleton of the non-crystalline polyester resin "a" is obtained by ring-opening polymerization of a meso-type DL-lactide.

7. The toner according to claim 1, wherein the toner is obtained by dissolving or dispersing the compound A1 having an active hydrogen group, the resin A2 having a portion reactive with the compound A1 , the second resin B, the coloring agent, and the releasing agent in an organic solvent to obtain a lysate or a dispersion material, dispersing or emulsifying the lysate or the dispersion material in an aqueous medium to conduct cross-linking reaction or elongation reaction of the compound A1 having an active hydrogen group and the resin A2 to obtain a liquid dispersion or an emulsified liquid, and removing the organic solvent from the liquid dispersion or the emulsified liquid after or in the middle of the cross-linking reaction or elongation reaction.

8. An image forming method comprising; forming a latent electrostatic image on an image bearing member;

developing the latent electrostatic image with a development agent comprising a carrier and the toner of claim 1 to obtain a toner image;

transferring the toner image to a recording medium; and fixing the toner image on the recording medium.

* * * * *